US005698031A

United States Patent [19]

Winkle

[11] Patent Number: 5,698,031

[45] Date of Patent: Dec. 16, 1997

[54] APPARATUS FOR DISTRIBUTING FLUID ONTO A WORKPIECE

[76] Inventor: William L. Winkle, 822 Bear Creek Rd, Cabot, Pa. 16023

[21] Appl. No.: 604,466

[22] Filed: Feb. 21, 1996

[51] Int. Cl.[6] ..... B05C 11/00; B05C 1/06; B05C 1/08

[52] U.S. Cl. ..... 118/264; 118/265; 427/368

[58] Field of Search ..... 427/429, 368; 118/264, 265, 260

[56] References Cited

U.S. PATENT DOCUMENTS

| | | | |
|---|---|---|---|
| 425,795 | 4/1890 | Hotchkiss . | |
| 2,032,744 | 3/1936 | Fessler et al. | 118/264 |
| 2,800,199 | 7/1957 | Mylnarek | 184/16 |
| 2,870,737 | 1/1959 | Byrnes | 118/227 |
| 3,427,840 | 2/1969 | Richter | 72/44 |
| 4,033,290 | 7/1977 | Dude | 118/266 |
| 4,408,688 | 10/1983 | Bieri | 198/500 |
| 5,523,123 | 6/1996 | Ginzburg et al. | 118/264 |

*Primary Examiner*—Donald E. Czaja
*Assistant Examiner*—Jacqueline A. Ruller
*Attorney, Agent, or Firm*—George C. Atwell

[57] ABSTRACT

An oiling device for distributing fluid, such as oil, onto a continuously moving strip of sheet material, such as steel or other non-ferrous based materials, includes an oil reservoir which is in flow communication with an elongated manifold disposed above and extending the width of the moving sheet material and through which fluid is distributed, a plurality of pumps serially mounted superjacent to and in flow communication with the manifold, and a plurality of springs serially mounted to the bottom of the manifold with each respective spring paired with each respective pump. The springs deflect to or away from the moving sheet material due to the changing physical characteristics of the material as it passes beneath the springs, and each spring includes an applicator disposed immediately above the sheet material and through which oil flows for distribution on the entire width of the material. A main shaft extends through the line of pumps and is driven by either a variable speed motor or a traction roll and linkage arrangement so that rotation of the shaft causes the continuous circulation of oil through the pumps, to the applicators, and then onto the sheet material.

15 Claims, 10 Drawing Sheets

APPARATUS FOR DISTRIBUTING FLUID ONTO A WORKPIECE

BACKGROUND OF THE INVENTION

The present invention relates to apparatus for treating sheet material, and more particularly pertains to an apparatus for distributing oil onto a moving strip of flat sheet material, such as an elongated strip of steel, in order to prevent the rusting and deterioration of the steel or for the application of an accurate and evenly applied coating, such as lubricants, necessary for deep drawing or forming operations.

In order to create the finished steel used in the wide variety of consumer and industrial products, which include household appliances, motor vehicles and construction equipment, cans, containers, and commercial and industrial tools and hardware, the steel must undergo a number of processes in order to transform the raw material into strong, durable, long-lasting finished steel.

Steel mills typically have a number of different lines for treating and processing the steel, and these lines may include pickling, galvanizing, tempering, and finishing lines. After the steel goes through one of the lines, the steel is wrapped by belt wrappers onto rotatable mandrels to form steel coils. The coils are stored in various locations throughout the mill. Since the steel is run by the mill to achieve the greatest productivity, the coils may sit for weeks or months until a customer places an order, and then one coil may be unwrapped so that several hundred feet can be removed. Or a customer may want to manufacture tin cans, for example, so the mill will unwrap and run portions of several coils searching for the one steel coil the mill will tin for that customer. The coils will then be rewrapped and sit as stock for weeks or months until another customer places an order in which case the coils will be handled again.

After each handling, and before the steel is rewrapped and coiled, the steel will have oil applied thereto to prevent the rusting and deterioration of the steel. Thus, oiling of steel occurs at a number of locations in the mill to preserve the steel so that the steel can be stored for an indeterminate time period until it is needed for some process, such as pickling, tempering, galvanizing, or tinning.

For example, in a typical steel-making process, the steel is first made into hot bars in a hot melt mill and then rolled into coils in a rolling mill while still hot. However, the surface of the steel will have scales and other impurities on it that prevent it from taking a galvanizing, tinning, or coating process. Therefore, the steel undergoes a pickling or cleaning process whereby it is treated with a flux (hydrochloric acid) which etches and cleans the steel. This is done by having the steel come off the coil and serpentine into and out of a line of acid tanks (perhaps stretching 400 to 500 feet), and when the steel leaves the last acid tank, the steel is sprayed by a substance which neutralizes the acid.

The next step is to blow dry the strip with high velocity air blowers to remove the remaining moisture. Despite this treatment, some remnants of moisture remain on the steel. If the steel were to be coiled after going through the pickling line but before going through, for example, the galvanizing line, the steel would immediately start to rust and would be unusable.

In order to prevent rust and deterioration from occurring, the mill must treat the steel with some type of substance, such as oil. Even if the oil has to be removed later on, the mill has at least prevented the coiled steel from rusting at this stage of its processing.

Another example where the steel coils must be treated to prevent rusting is for customers who buy raw coils for processing by their own galvanizing lines. Such customers may only do galvanizing, and so they buy steel coils from the steel company and then pickle and galvanize the steel. Such customers demand that the initial steel producers oil and protect the coils so that the customer does not start out with a rusty coil.

Tempering mills also require the steel strip to be clean and dry in order to go through the mill properly. However, the tempering process raises the surface temperature of the steel, and the manufacturer does not want the steel coil sitting unprotected in the mill. Because of the high surface temperature of the steel, as the steel cools, it will pass through the dew point (the temperature at which the air just becomes saturated), and as the steel passes through the dew point, it will actually condensate moisture out of the atmosphere and onto the product. Even if the mill is not going to pickle or galvanize the steel and they are only changing the surface condition of the steel by the tempering process, the mill will apply oil to the steel for the above reason.

Among the prior art devices which apply or treat a surface of sheet material with a lubricant, such as oil, are the Hotchkiss apparatus (U.S. Pat. No. 425,795), the Mlynarek lubricator (U.S. Pat. No. 2,800,199), the Byrnes oiler (U.S. Pat. No. 2,870,737), the Richter automatic stock lubricating system (U.S. Pat. No. 3,427,840), and the Bieri device (U.S. Pat. No. 4,404,688).

In addition to the above devices, another method of applying oil to moving sheet material has been to mount a pipe having many drilled holes above and transverse to the sheet material. As the sheet material moves beneath the pipe, oil is forced into the pipe and through the holes whereupon oil dribbles through the holes and onto the sheet material. Downstream of the pipe are a series of wiping pads which contact the sheet material and essentially smear the oil on the upper surface of the sheet material. However, this technique wastes oil as there is no control of the amount of oil being applied to each square centimenter of the sheet material passing beneath the pads nor is there any control of the density or thickness of the oil being applied to the surface of the sheet material.

While these devices apply oil to a surface of sheet material, there remains a need for an oiling device or apparatus which applies a known amount of oil or other lubricant in an even coating across the strip. This device would also have the capability to adjust the amount of oil supplied to meet a specific required coating thickness on the moving sheet material. This device should also be able to accommodate variations in the physical characteristics of the sheet material while still continuously applying an even coating of oil thereto.

SUMMARY OF THE INVENTION

The present invention comprehends an apparatus for distributing fluid onto a workpiece, and particularly pertains to an apparatus for distributing and applying a uniform coating of oil onto the surface of a moving strip of sheet material, such as a flat strip of steel, aluminum, or brass.

The invention includes an elongated manifold positioned immediately above and transverse to the moving sheet material. The manifold is wider than the sheet material and is supported at either end by support members and bracket structure so that the manifold is superjacent the sheet material. The manifold includes a main passageway extending the length of the manifold. An oil reservoir or container is located adjacent the manifold and includes tubing which connects to the manifold so that the manifold is in flow communication with the reservoir and receives a steady supply of oil from the reservoir.

A plurality of pumps are serially mounted upon the upper flat surface of the manifold and extend from one end of the manifold to the opposite end. Each pump is an individual peristaltic pump unit, but all the pumps receive oil from the manifold and simultaneously pump oil through the manifold by the rotation of a main shaft or spindle that extends through the entire line of pumps.

The main shaft can be driven by either a variable speed AC or DC motor mounted to one side of the manifold or by a traction roll and linkage arrangement. In the traction roll and linkage arrangement, the traction roll is located upstream (or ahead of) the pumps and manifold and is rotated by frictional contact with the forwardly-moving sheet material. As the sheet material travels forward and rotates the traction roll, a gear and linkage (chain) drive system drivingly connected to the traction roll also rotates. This rotation is transmitted to the main spindle which thereby causes the pumps to push oil through the pumps and down toward the sheet material. The velocity of travel of the material determines the rate at which oil flows through the pumps and onto the sheet material. A slow moving strip of sheet material results in a small volume of oil being circulated through the pumps in a unit time while, conversely, a fast moving strip of sheet material results in a larger volume of oil being circulated through the pumps in a unit time.

Secured to the undersurface, and toward the front, of the manifold is a steel guard. The guard extends transverse to the moving sheet material and is coequal in length with the manifold. The guard protects structure hereinafter further described from being damaged should the sheet material happen to lift off the conveyor belt or supporting surface upon which the material is traveling as it approaches the apparatus.

A plurality of U-shaped springs are serially mounted to the undersurface of the manifold behind the guard. The springs extend transverse to the sheet material and the mouth of the springs open downstream—or to the rear of the pumps and manifold—relative to the path of travel of the material. The springs are capable of deflection to or away from the material as a result of variations in the physical characteristics of the material. Specifically, variations or undulations across the width of the sheet material, referred to in the industry as center buckle and edge ripple, will cause one or several adjacent springs to deflect upward or downward as the springs accommodate the variations or undulations across the width of the sheet material as it moves forward and underneath the apparatus. Furthermore, each respective spring is paired with a respective pump so that an individual standing downstream of the apparatus would view a line of pumps mounted to the upper surface of the manifold and a line of springs secured to the undersurface of the manifold with each spring vertically aligned with a respective pump.

Secured to the unattached prong or end portion of each spring which is opposite the spring portion mounted to the manifold undersurface is a removably attachable applicator. Each spring also includes a hose or tubing extending within each respective spring, and each hose has a first end in flow communication with the manifold and a second end in flow communication with the applicator so that oil can flow through the manifold, into and through each hose, and then into each applicator.

Enclosed within each applicator is a brush material or spreading material; and in the apparatus of the present invention, the material includes a plurality of rectangular or square-shaped, non-woven, spun-bonded nylon material stacked and squeezed within each applicator. The nylon material is stacked within each applicator so that the nylon material is perpendicular to the flat surface of the sheet material and can be aligned either diagonal or parallel to the line of travel of the sheet material. The nylon material acts as wicking material; oil is forced by the pumps through each respective hose so that the nylon material becomes supersaturated. When the nylon material becomes supersaturated, oil will come out of the nylon material and be distributed or applied to the moving strip of sheet material. When the nylon material becomes supersaturated, the same amount of oil being forced into the nylon material of each applicator will be forced out and onto the moving strip of sheet material. This assures that the amount of oil applied to the sheet material will be constant throughout the time of operation of the apparatus on that moving strip of sheet material.

Therefore, an objective of the present invention is to provide an apparatus for applying a uniform coating of oil to the surface of a moving strip of flat sheet material.

Another objective of the present invention is to provide an apparatus which applies an even coating of oil across the entire width of the moving strip of sheet material for the entire length of the strip of sheet material being processed.

Yet another objective of the present invention is to provide an apparatus which is capable of applying a uniform coating of oil across the width of the moving strip of sheet material despite the fact that the moving strip bends and undulates across its width creating troughs and peaks to which the coating of oil must be applied.

Other features, objects, and characteristics of the apparatus will be understood and appreciated from the ensuing detailed description of the several preferred embodiments of the invention, when read with reference to the accompanying drawings.

DETAILED DESCRIPTION OF THE PREFERRED EMBODIMENT

Figure 1:
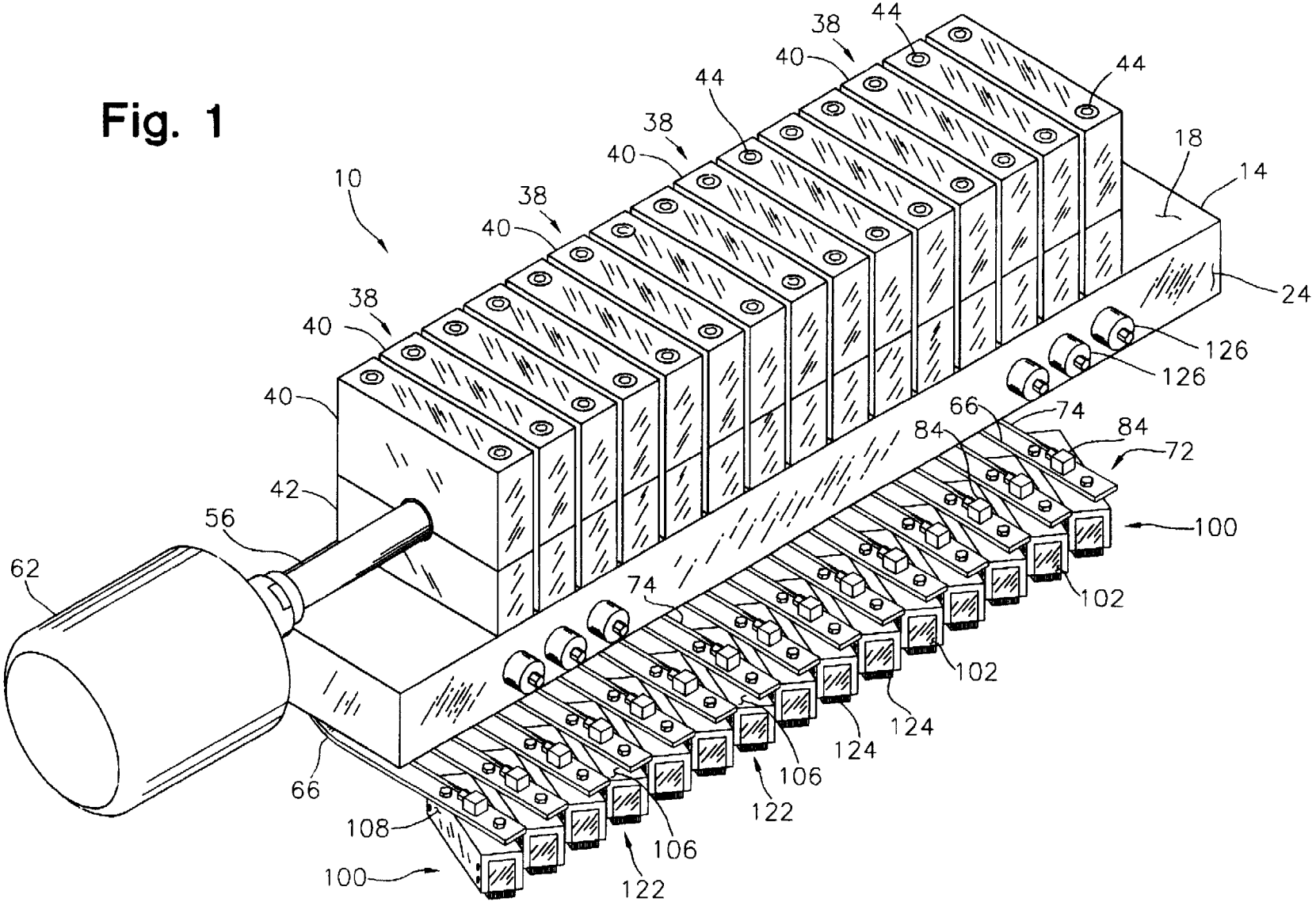
FIG. 1 is a perspective view of the preferred embodiment of the apparatus of the present invention.

Illustrated in FIGS. 1–20 is an apparatus for dispersing fluid onto an article or workpiece. More particularly, the apparatus is an oiling device 10 and the fluid which is dispersed onto the workpiece is a lubricant which, in nearly all cases, is oil. The oiling device 10 is mainly used in metal processing lines in the steel industry, and the workpiece is a long strip of generally horizontally-moving sheet material 12, such as a long strip of aluminum, brass, steel, or other non-ferrous material, which passes beneath the device 10 and upon which the oil is continuously dispersed in a uniform coating across the width of the material 12. The device 10 can be used in any industry where treatment of the material is required in order to prevent rust, corrosion, and deterioration of the material.

As illustrated in FIGS. 1–5 and 15–20, the device 10 includes an elongated, generally rectangular-shaped manifold 14 positioned above the path of the moving material 12. The manifold 14 includes a number of drilled passageways or channels, one of which is an elongated main passageway 16 through which oil can flow, and this passageway 16 extends substantially the length of the manifold 14. The manifold 14 is located above and transverse to the material 12 and is supported by mounting structure (not shown), such as support brackets and support members. The mounting structure can vary from operation to operation; however, the manifold 14 must be spaced above and extend transverse to the material 12 in each operation. The manifold 14 includes a top surface 18, a bottom surface 20, an elongated, upstream-facing surface 22, and an opposite elongated, downstream-facing surface 24. A number of vertically-extending drilled passageways or channels 26 extend up to and communicate with the surface 18. "Upstream" refers to the area relative to the device 10 where the material 12 is just coming into it and does not have oil applied thereto. "Downstream" refers to the area relative to the device 10 where the material 12 has passed the device 10 and has had oil applied thereto.

Figure 2:
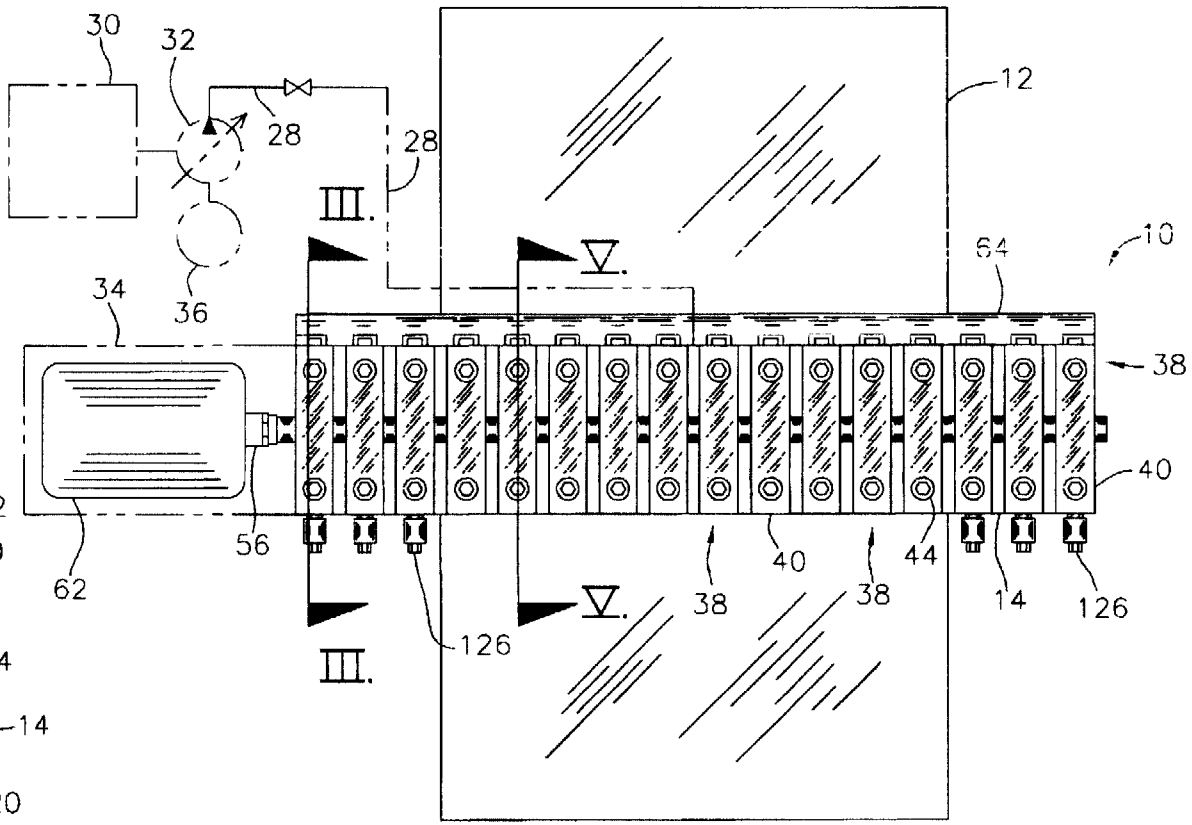
FIG. 2 is a top plan view of the apparatus first shown in FIG. 1 with a strip of flat sheet material passing therebeneath.

As shown in FIG. 2, a hose or oil line 28 extends from a fluid reservoir, tank, or container 30 adjacent to the manifold 14 so that the container 30 is in flow communication with the manifold 14. A centrifugal pump 32 mounted on a skid plate 34 provides the force for moving the oil from the container 30 through the line 28 and into the passageway 16. The pump 32 is powered by a motor 36 which can vary up to 10 hp. The amount of oil being fed through the line 28 and into the manifold 14 is measured in cubic inches per minute.

As shown in FIGS. 1–5 and 15–20, a means for forcing or moving fluid, such as oil, through the manifold 14 and onto the sheet material 12 is disclosed. The means for forcing fluid through the manifold includes a plurality of pumps 38 are serially mounted to and aligned on the surface 18 from one end of the manifold 14 to its opposite end. Specifically, the pumps 38 are peristaltic pumps which are used in process, laboratory, and industrial settings and applications. Peristaltic pumps are used to pump a wide variety of corrosives, abrasives, and viscous materials, which include, but are not limited to, effluents, limestone, sludge, slurries, a wide range of acids, plating solutions, glues, hardeners, ceramic slips, glazes, latex, cosmetics, food materials, and waste and residues. Peristaltic pumps are chemical and corrosion resistant and can accommodate AC, DC, and pneumatic pump drives.

As shown in FIGS. 1–5 and 15–20, each pump 38 includes a cap block 40 which is secured to a lower block 42 by a pair of elongated screws or cap bolts 44 which extend through the block 40 and down into the block 42. The blocks 40 are arch-shaped and have their central portions removed to accommodate a structure which will now be described. Disposed within each pump 38 is an arcuate piece of tubing 46 which has a first end 48 in flow communication with one channel 26 and a second tube end 50 in flow communication with another channel 26 drilled through each manifold 14. Specifically, the tubing 46 is a flexible tygon tubing which is commonly used with peristaltic pumps. Tygon tubing is known for its superior flow characteristics, flexibility, abrasion resistance, and chemical resistance. Tygon tubing is also non-oxidizing, resistant to acids, alkalis, and oils, and complies with FDA regulations for material in contact with edible products. When used in a laboratory setting, tygon tubing is non-toxic, non-contaminating, and able to safely handle most inorganic laboratory chemicals.

Figure 3:
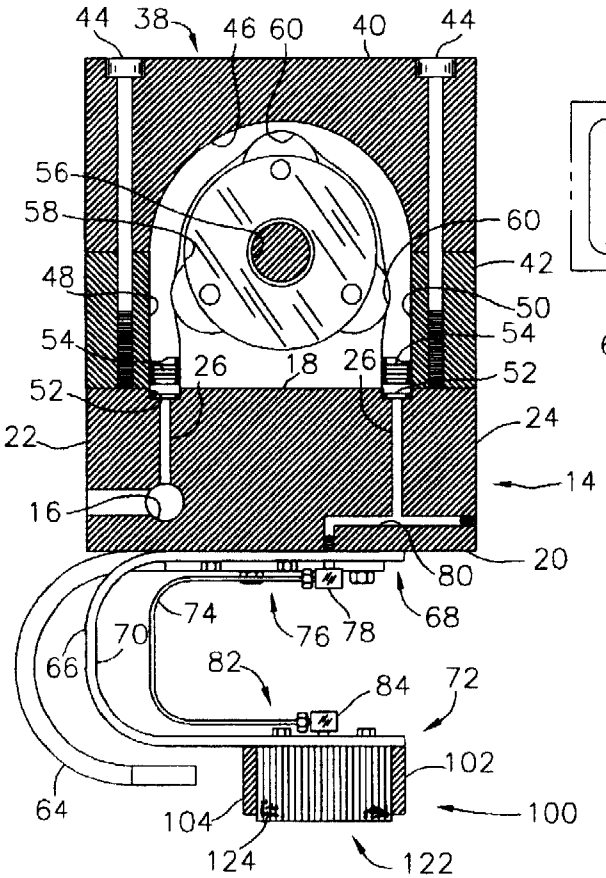
FIG. 3 is a side elevational view of the apparatus first shown in FIG. 1 taken along lines III—III of FIG. 2.
Figure 4:
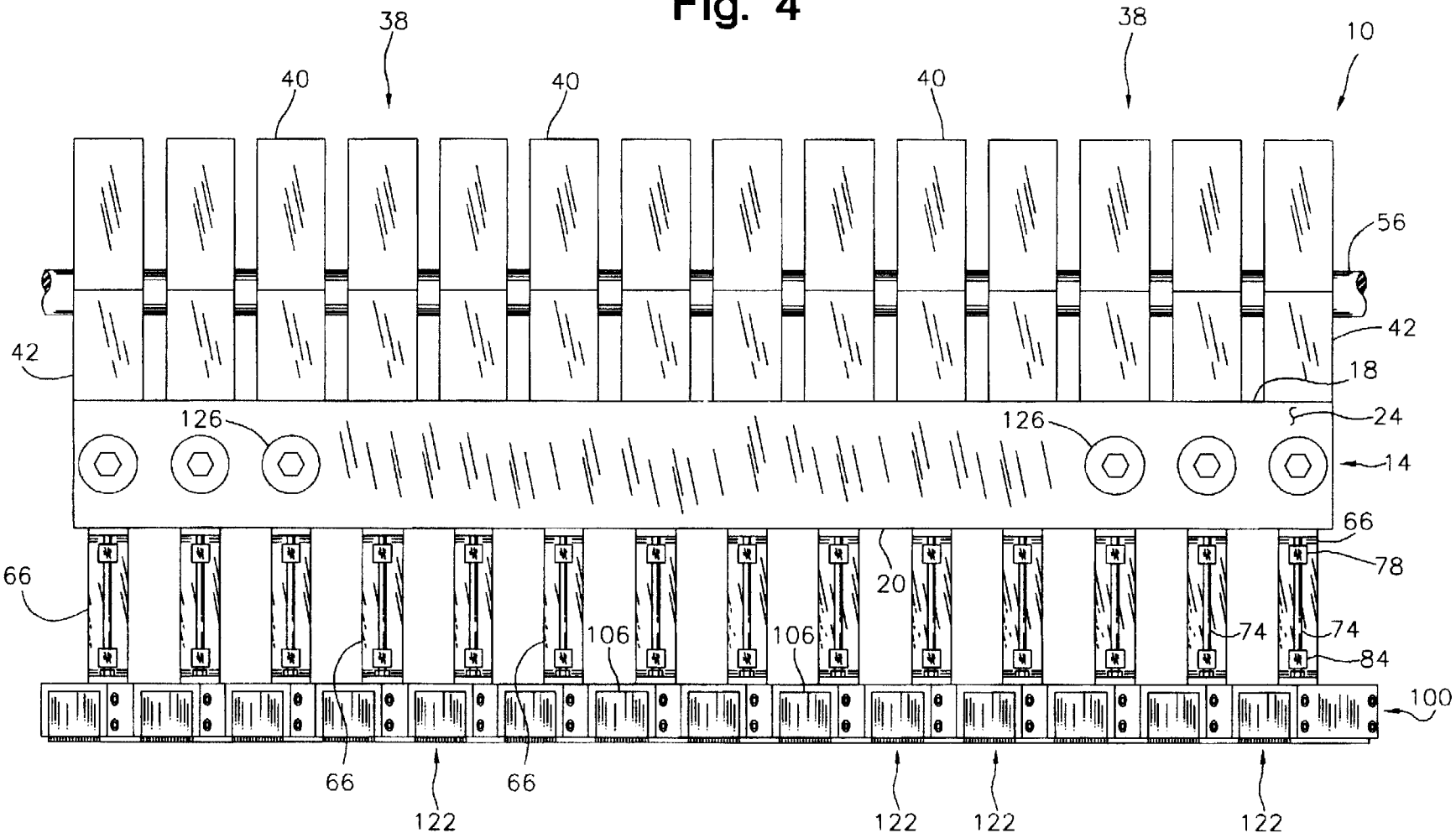
FIG. 4 is a rear elevational view of the apparatus first shown in FIG. 1.
Figure 6:
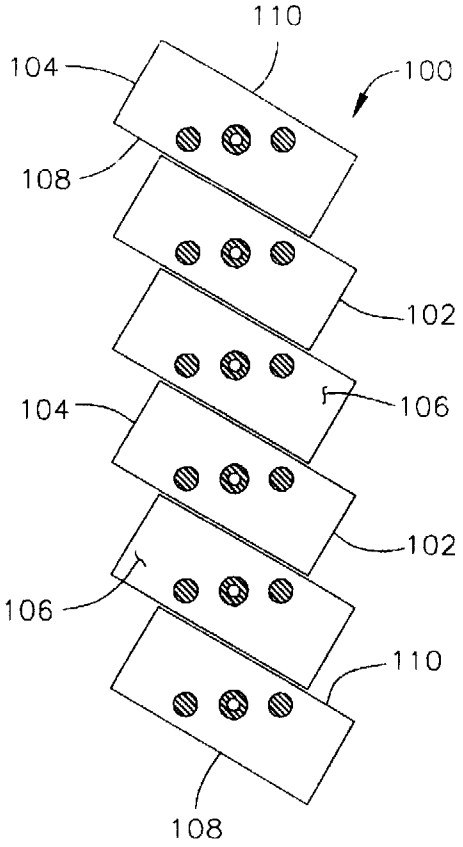
FIG. 6 is a top plan view showing the arrangement of the applicators of the apparatus first shown in FIG. 1.
Figure 5:
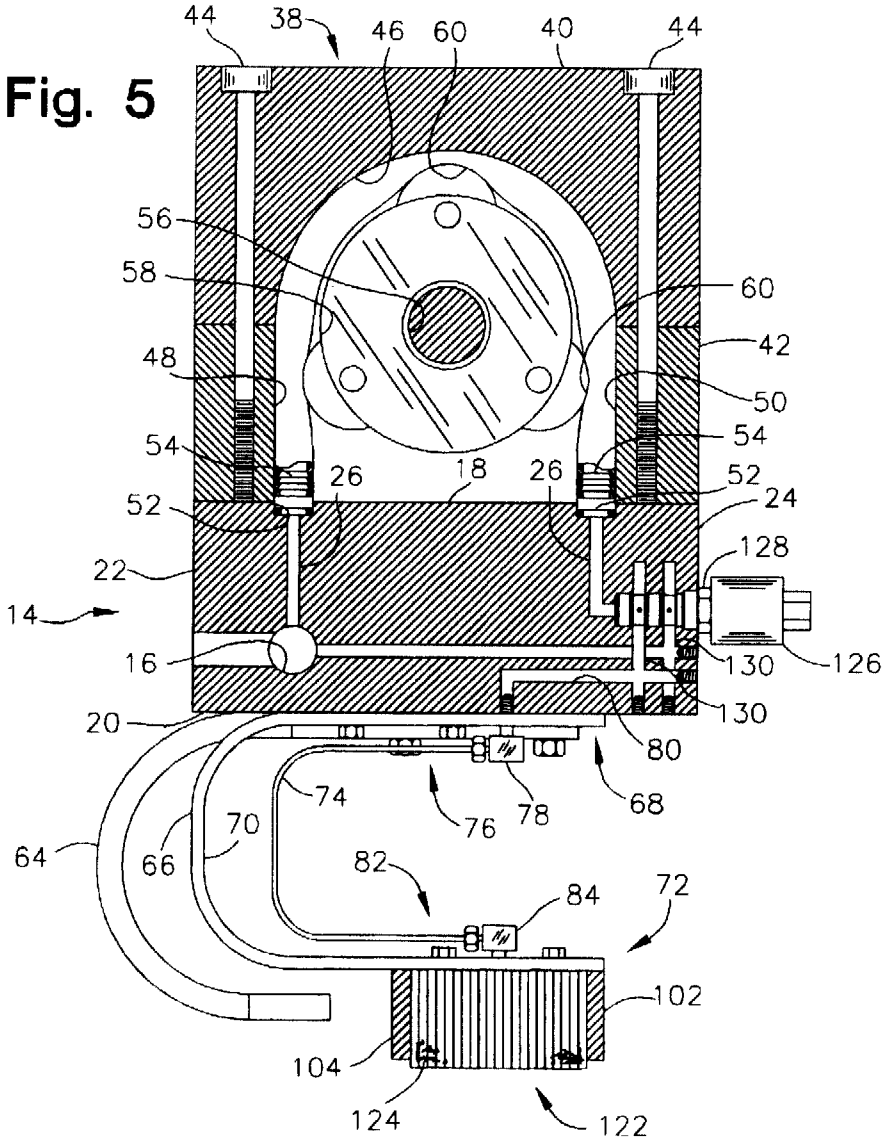
FIG. 5 is a side elevational view of the apparatus first shown in FIG. 1 taken along lines V—V of FIG. 2.

The tubing ends 48 and 50, as shown in FIGS. 3 and 5, fit down over or slip over an O-ring transfer bushing 52 and hose barb 54 which is seated within respective recesses on each block 42, and the ends 48 and 50 are held in place by the barbs 54. When the tubing 46 cracks, wears out, or springs a leak, the bolts 44 for that respective pump 38 can be released, the block 40 can be lifted up and removed, and the piece of tubing 46 can be pulled out. Lifting up the tubing 46 also pulls out the barbs 54 and bushings 52. The tubing 46 can be cut or pulled off the barbs 54 and bushings 52 and a new piece of pre-measured tubing 46 can then be pushed down over the barbs 54 and bushings 52 after they have been repositioned within their seats on the manifold 14.

Extending through the serially-aligned pumps 38, and upon which the pumps 38 are ganged together, is a main drive shaft 56. Each pump 38 includes a pair of discs 58 which are mounted to that portion of the shaft 56 extending through each pump 38. Positioned between each pair of discs 58 are a plurality of impeller rollers 60, and, in the present invention, three rollers spaced generally 120° from each other are mounted between each pair of discs 58 by pins which extend through the center of the rollers 60 and which are secured to each respective pair of discs 58.

Rotation of the shaft 56 causes each pair of discs 58 to rotate, and this rotation causes the rollers 60 to roll on the tubing 46 because the rollers 60 are rotatably fastened between the pairs of discs 58 by the pins. The contact and compression of the rollers 60 against the tubing 46, as shown most clearly in FIGS. 3, 5, 15, and 16, causes the fluid to be moved through the tubing 46, and, thus, the continuous rotation of the shaft 56 causes the rollers 60 to roll on and compress the tubing 46 so that a continuous and uniform fluid flow is transmitted through the tubing 46. Depending upon the size of the pumps 38 and the size of the pump drive, peristaltic pumps can achieve flow rates ranging from 0.001 ml/min. to 14 gpm and up to 1200 gph. In the present invention, a motor 62 used for driving the main shaft 56 varies up to 7½ hp.

Among the advantages of using peristaltic pumps for the device 10 is that these pumps 38 have no need of an inlet or outlet check valve because in operation the rollers 60 grip and compress the tubing 46 and actually stop fluid flow from going backwards by the direction of their rotation so there is no need for a check valve on either the first—inlet—tube end 48 or on the second—outlet—tube end 50. In addition, the rollers 60 rotate extremely slowing for the amount of oil being pushed through the tubing 46 for eventual dispersion on the material 12. The rollers 60 rotate at generally a slow rpm of between 0–55; in fact, for this application, operating the pumps 38 at a high rpm, such as 1,000 rpms, would be detrimental to the tubing 46 insofar as there would be a tendency to scratch and scuff the tubing 46 which would thus decrease its durability and wearability. By using multiple pumps 38 ganged together on one shaft 56, the device 10 provides segment control of oil distribution over the transverse width of the material 12, and also obviates the need to place oil upon the moving material 12 and then use some mechanical means to spread the oil on the surface of the material 12. Moreover, the use of multiple pumps 38 driven by a single shaft 56 permits close control of the amount of oil being distributed on the material 12 so that a very thin, uniform coating of oil is dispersed thereon. The amount of oil may be no more than five grams per square foot, and peristaltic pumps, such as the pumps 38, are ideal for achieving this type of uniform oil distribution on the material 12.

As shown in FIGS. 2–5 and 15–20, an elongated guard 64 is mounted to the surface 20, coextensive in length with the manifold 14 and extending transverse and above the moving material 12. During application of oil to the material 12, the material 12 could lift up off the conveyor belt or flat surface upon which it is traveling, thus damaging structure located beneath the manifold 14 which will be hereinafter further described. However, the location of the guard 64 at the upstream portion of the device 10 protects this structure from being damaged should the material 12 lift up during its forward and horizontal movement beneath the device 10.

Illustrated in FIGS. 1, 3–5, and 15–17 is a deflection means in the form of a plurality of U-shaped springs 66 set on their sides and serially mounted to the surface 20 so that each spring 66 is paired with a respective pump 38. The springs 66 are steel leaf springs and are capable of deflection up or down in a direction perpendicular to the material 12, and the deflection of the springs 66 accommodates the variations in the physical characteristics of the material 12. Each spring 66 includes an upper end 68 mounted to the surface 20, a bight portion 70 pointing upstream, and an opposite lower end 72 positioned immediately above the material 12. The mouths of the springs 66 open downstream.

Figure 16:
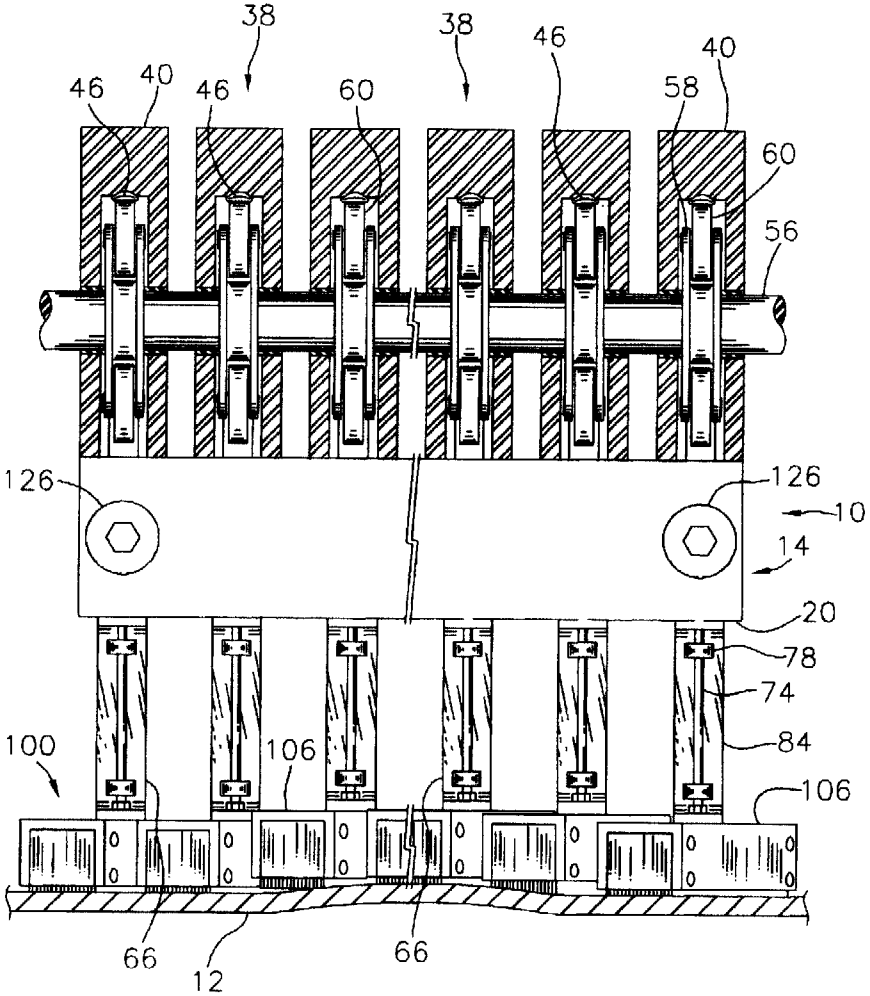
FIG. 16 is a rear elevational view of the apparatus first shown in FIG. 1 illustrating the deflection of a central group of applicators due to the undulations in the sheet material.
Figure 15:
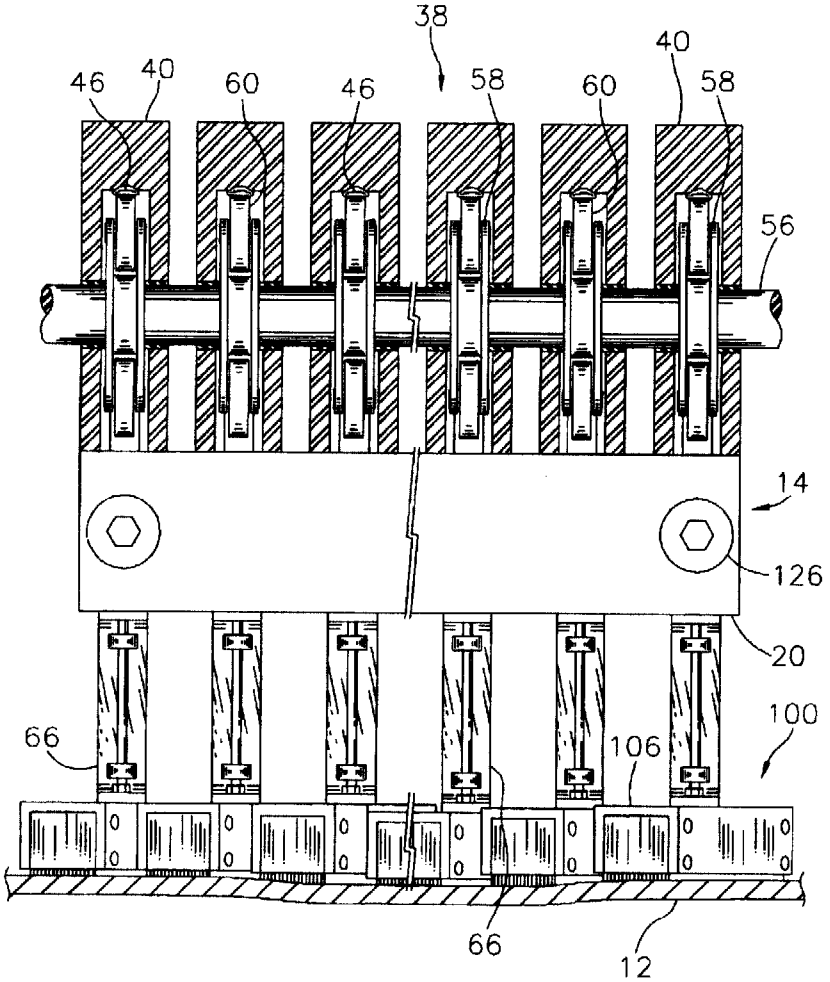
FIG. 15 is a rear elevational view of the apparatus first shown in FIG. 1 illustrating the deflection of edge applicators due to the undulations of the sheet material passing therebeneath.

The material 12 is not perfectly flat but has undulations in the form of peaks and valleys across its transverse width. These variations or undulations are known in the industry as edge ripple or center buckle, and, as shown in FIGS. 15 and 16, edge ripple causes the sides of the material 12, such as a finished steel strip, to bend upward toward the end portions of the manifold 14 and the springs 66 and pumps 38 adjacent to the end portions of the manifold 14. Center buckle occurs when the center of the material 12 buckles upward toward the springs 66 located in the middle portion of the manifold 14. Therefore, standing downstream of the moving material 12 and looking upstream toward the device 10 when it is in operation, an observer would view a continuously changing profile of the material 12 whereby the material 12 would edge ripple, then, perhaps a millisecond later, center buckle, and then, a millisecond after that, edge ripple again. These undulations would occur across the transverse width of the material 12 for the full length of the material 12 being treated by the device 10. However, there will not be a case where the deformations or undulations of the material 12 will cause both a center buckle and edge ripple to occur at the same time across the width of the material 12. As will be more fully described hereinafter, the springs 66 must be capable of deflection at least three-quarters of an inch to or away from the material 12 so that structure which will be further described will not be damaged or broken. In order for the guard 64 and the plurality of springs 66 to be secured to the surface 20, the guard 64 will be notched adjacent the spring end 68 to allow the guard 64 to be slipped between the line of springs 66, and both the springs 66 and the guard 64 are secured by being bolted to the surface 20.

As shown in FIGS. 1, 3–5, 9, 11, and 15–17, a plurality of flexible hoses 74 are used to transmit fluid from the manifold 14 to the material 12. Specifically, each spring 66 and each pump 38 includes a flexible hose 74, and each hose 74 is disposed within and generally follows the inner concavity of the bight portion 70. Each hose 74 has an upper end 76 which is secured or inserted into a pipe fitting or transfer housing 78 and the housing 78 is then secured at the end 76 and is in flow communication with an outlet or discharge passageway 80 of the manifold 14. Each hose 74 also includes an opposite lower end 82 which is also inserted or fitted into a pipe fitting or transfer housing 84. Both of these housings 78 and 84 are, in turn, fitted to the spring ends 68 and 72. Thus, oil will flow through the passageway 80 adjacent the surface 20, then through the housing 78 secured to the spring end 68, then into and through the hose 74 and to the housing 84 secured to the hose end 82. Each respective hose 74 will flex within the portion 70 in which it is located concomitant with the upward or downward deflection of that spring 66 as that spring 66 encounters the variations or undulations (edge ripple or center buckle) along the width of the material 12.

Figure 8:
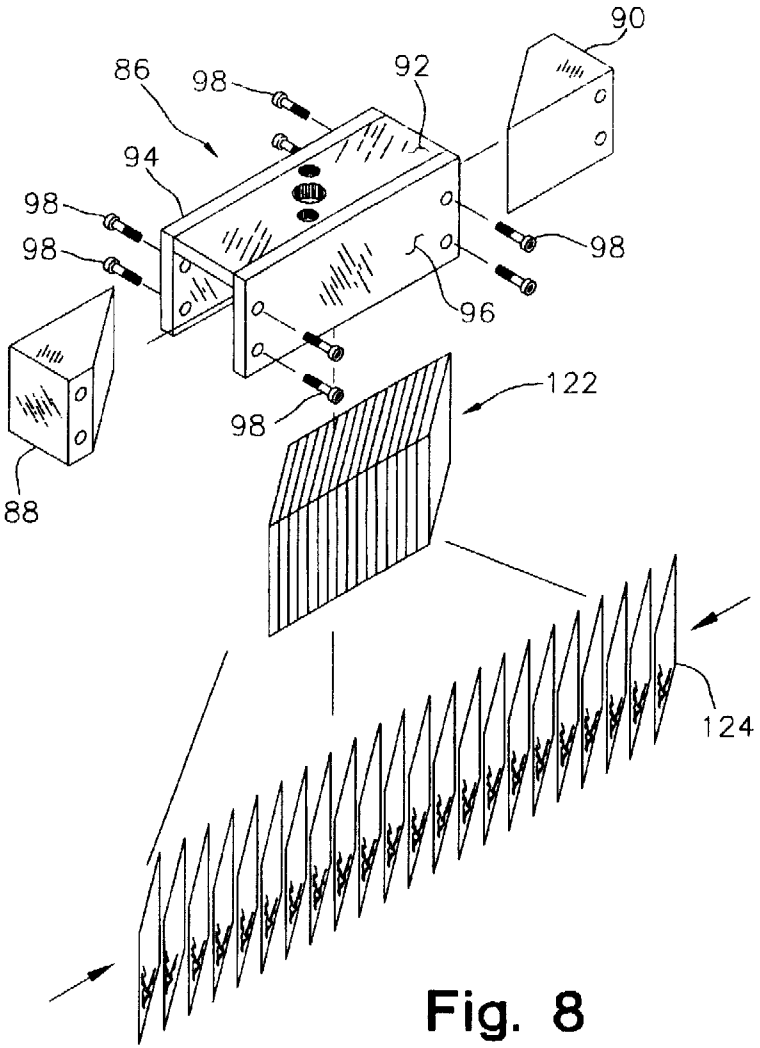
FIG. 8 is an exploded isometric view illustrating the brush material and an alternate embodiment for the applicator first shown in FIG. 7.
Figure 7:
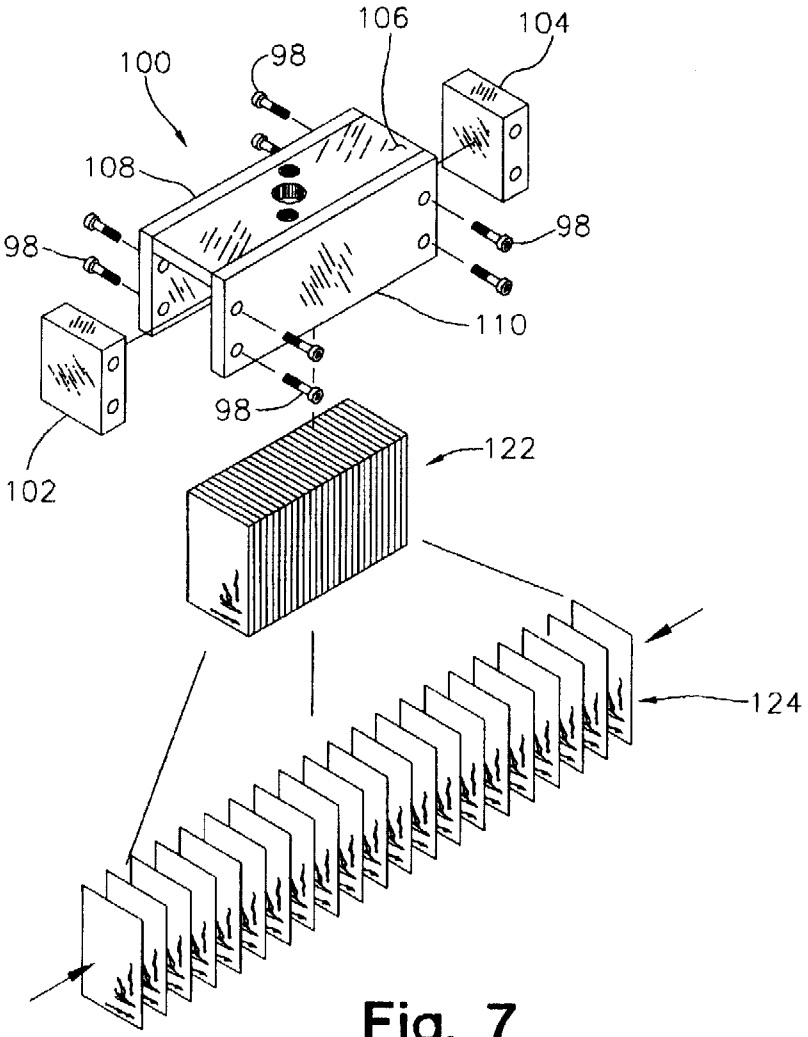
FIG. 7 is an exploded isometric view illustrating the brush material and the assembly of the preferred embodiment of the applicator.

Illustrated in FIGS. 1 and 3–20 is an application means or a means for distributing or dispersing fluid onto the material 12 so that the entire width of the material 12 receives a uniform coating of fluid as the material 12 moves therebelow, and the means for distributing the fluid onto the material 12 is mounted to each respective spring end 72 superjacent the material 12 and in flow communication with each respective hose 74. Specifically, the means for distributing or dispersing fluid includes a plurality of applicators which are removably attachable to the spring end 72. The present invention uses two different types of applicators which are shown in FIGS. 7 and 8, respectively. An applicator 86, shown in FIG. 8, includes a back side material-aligning angled end cap 88 which faces downstream, an opposite front side material-aligning angled end cap 90 which faces upstream, a top cap 92, a left side member 94, and an opposite right side member 96. The top cap 92 includes a through-hole which accommodates the housing 84 and allows the fluid to flow from the hose 74 and into the interior region of the applicator 86. The applicator 86 is assembled by having fasteners, such as pan head screws 98, inserted into the edges of the side members 94 and 96 and into aligned holes in the end caps 88 and 90. The smaller through-holes located on the top cap 92 are for mounting the applicator 86 to the spring end 72 by inserting screws therethrough and into the spring end 72 to attach the applicator 86 to the spring 66.

Shown in FIG. 7 is a standard applicator 100 arrangement. This embodiment includes a back side material-aligning straight end cap 102 facing downstream, an opposite front side material-aligning straight end cap 104 facing upstream, a top cap 106, a left side member 108, and an opposite right side member 110. The top cap 106 includes a through-hole into which the housing 84 and the hose 74 are inserted so that fluid can flow from the hose 74 and into the interior region of the applicator 100. The two smaller through-holes in the top cap 106 align with through-holes in the spring end 72 so that the applicator 100 can be removably mountable to the respective spring end 72 by the insertion of screws or fasteners therethrough. These applicators 100 are shown mounted to the respective spring ends 72 of the device 10 in FIGS. 1, 3–5, 9–11, and 15–17.

Figures 9, 10:
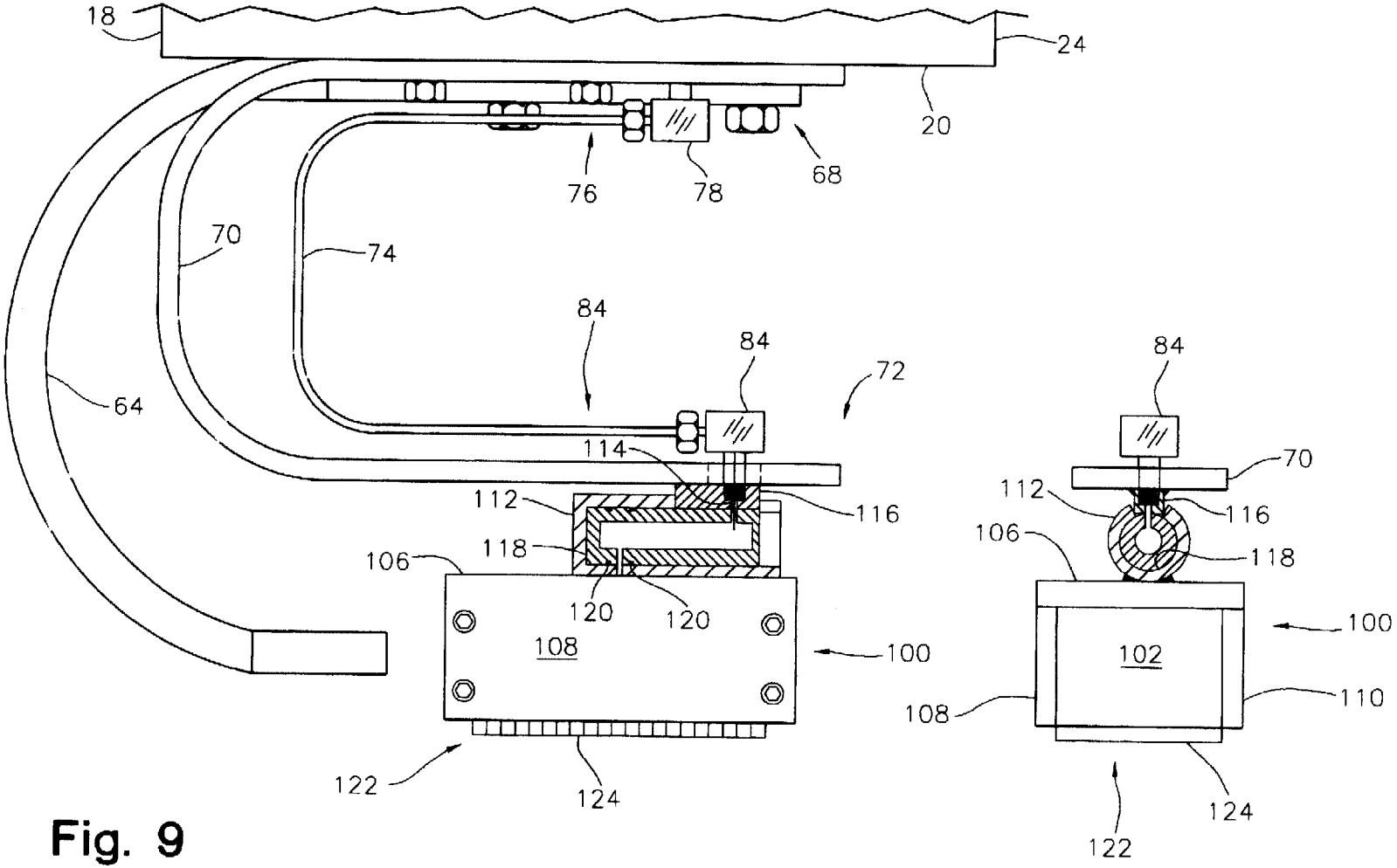
FIG. 9 is a side elevational view of the applicator first shown in FIG. 1 illustrating an alternate embodiment for mounting the applicators of the apparatus.
FIG. 10 is a front elevational view of the applicator first shown in FIG. 1 illustrating the alternative embodiment for mounting the applicator to the apparatus.
Figure 11:
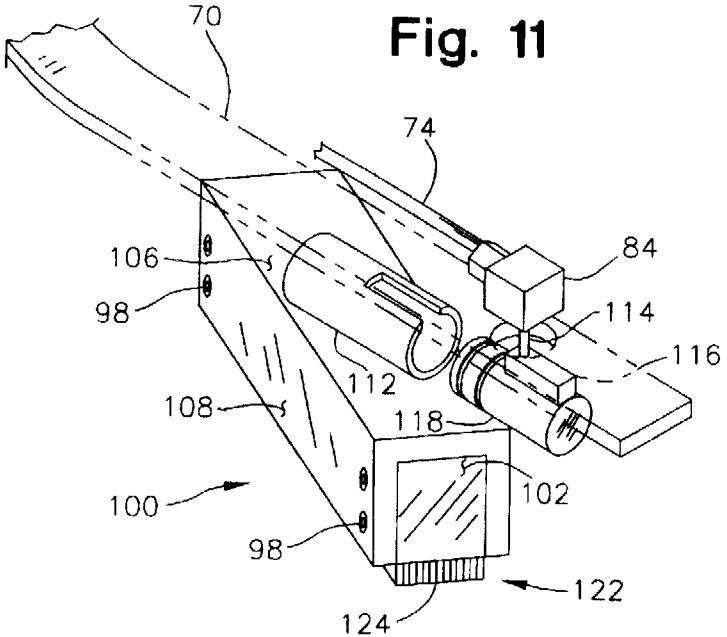
FIG. 11 is a perspective view of the applicator first shown in FIG. 1 illustrating the alternative embodiment for mounting the applicator which was first shown in FIG. 9.

In FIGS. 9–11 an alternative sliding clip means for attaching the applicator 86 or 100 to the spring end 72 is illustrated. Specifically, a female quick-connect slip-on coupler 112 is permanently fixed to the top cap 92 or 106. Projecting downward from the housing 84 and through the through-hole of the spring end 72 is a small tube 114 which is inserted into a spring attachment block 116. Secured to the block 116 is a male quick-connect holder 118 with at least two sealing O-rings 120 to prevent leakage of the fluid as it flows through the tube 114, into the block 116, and then through the holder 118 and coupler 112 whereupon the fluid enters the interior region of the applicator 86 or 100. The holder 118 is simply slipped onto the coupler 112 and the tight fitting between the holder 118 and the coupler 112 fixes them together and thus allows the applicator 86 or 100 to be mounted to the spring end 72. Despite the specific structure of the applicators 86 and 100, and their method of mounting to the spring end 72, it is essential that the applicators 86 and 100 be removably mountable thereto for reasons which will be hereinafter further described.

Figure 12:
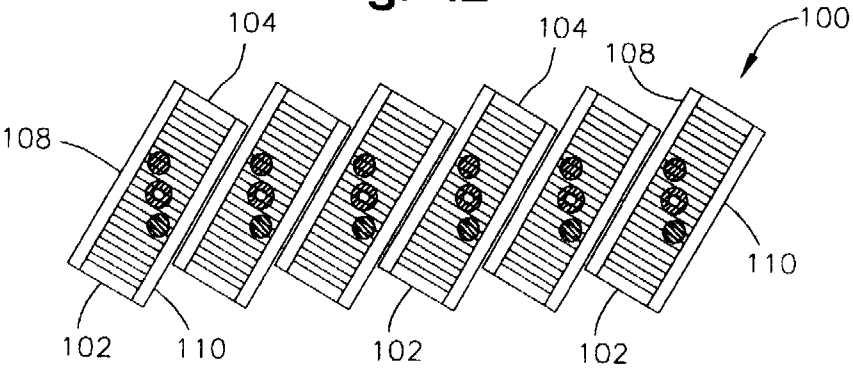
FIG. 12 is a top plan view of the applicators illustrating the preferred embodiment for arranging the brush material within the applicatiors.

As illustrated in FIGS. 1, 3–5, and 7–18, a spreading, brush, or synthetic pad material 122 is actually the material which absorbs oil egressing from each hose 74 and housing 84 and distributes or disperses the oil upon the upper flat surface of the moving material 12. The material 122 is actually a wafer-like, non-woven, spun-bonded nylon material that is tightly packed and compressed within the applicators 86 or 100. Each individual wafer 124 of the material 122 is paper-thin. The material 122 will be die cut into squares, as shown in FIGS. 7 and 12, and then the material will be stacked vertically and compressed to a certain density or durometer for packing within the applicators 86 or 100. In order to achieve the appropriate durometer, a press rated up to 20,000 pounds will be used. The portions of the material 122 that project down past the applicator 86 or 100 and toward the material 12 will be machined off to get a flat surface at the lower or bottom end of the compressed block of material 122. In order to properly distribute the oil as it egresses from the hoses 74 which are connected to and in flow communication with housings 84, the material 122 is stacked and squeezed within each applicator 86 or 100 so that it does not quite reach to the top caps 92 and 106 but a minute reservoir space is allowed between the top edge of the compressed material 122 and the top caps 92 and 106. In order to get a more uniform distribution of the oil across all of the top edges of the material 122, longitudinal channels (not shown) several thousandths of an inch deep can be milled into the bottom flat surface of the top caps 92 and 106. This would be one way to achieve very precise oiling to control the number of drops per inch given the width of the material 122 by first getting a uniform distribution of the oil across the top edges of the material 122. The material 122 may tend to blossom out minutely along the bottom edges because of the pressure of the loaded springs 66 pressing the applicators 86 or 100 down against the material 12 and also due to the fact that the durometer of the material 122 enclosed within the applicators 86 or 100 cannot be maintained in the small amount of material 122 sticking out from the bottom of applicators 86 or 100.

Figure 13:
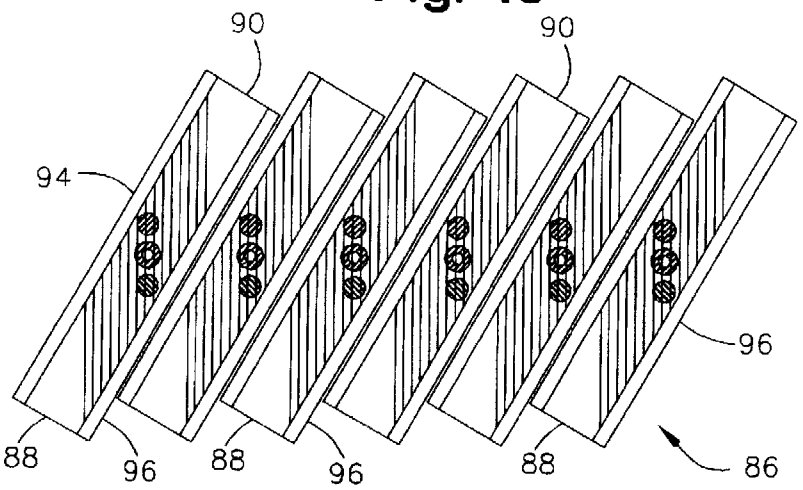
FIG. 13 is a top plan view of an alternate embodiment for the applicators which was first shown in FIG. 8 and illustrates the arrangement of the brush material therein.
Figure 14:
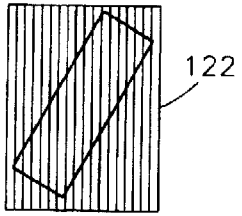
FIG. 14 is a top plan view of an alternate embodiment for cutting and arranging the brush material within the applicator first shown in FIG. 7.

As shown in FIGS. 3, 5, and 15–18, the material 122 is stacked within the applicators 86 or 100 perpendicular to the path of travel of the material 12. However, as shown in FIGS. 12–14, the material 122 is not arranged within the applicators 86 or 100 so that the material 122 is transverse to the line of travel of the material 12. If the material 122 were so arranged within the applicators 86 or 100, then any residual particles and other material on the surface of the material 12 would dam up in front of the material 122 and prevent the uniform distribution of oil onto the surface of the material 12. In addition, residual particles damming up in front of that portion of the material 122 that projects down past the applicator 86 or 100 and just slightly contacts the material 12 would cause the oil to be streaked on the material 12 creating bare spots that would not have any oil applied thereto. However, by arranging the material 122 within the applicator 86 or 100 in a direction either parallel with or diagonal to the material 12, as shown in FIGS. 8, 12, and 13, any slivers or residual particles that contact the material 122 will migrate up into the interstices of the material 122 so that they will not mar or scratch the moving material 12. This ability of the material 122 is further aided by the fact that the material 122 is less dense and has a lower durometer than the material 12; some of the steel may be ⅝-inch thick and, therefore, slivers will be forced to migrate into the material 122.

The applicators 86 and 100 are essentially little cassettes that will be approximately three inches long with a width less than three inches. The applicators 86 or 100 will be mounted to the spring ends 72 by either the sliding clip means, as shown in FIGS. 9–11, or as shown in FIGS. 1, 3–5, and 15–17. The assembly of the applicators 86 and 100 and their mounting to the springs 66 as well as the various ways to stack the material 122 within the applicators 86 and 100 provide a number of advantages in controlling the amount of oil which is applied to the material 12.

For example, if the customer notices that a particular brush (the term "brush" denotes one applicator 86 or 100 with the material 122 stacked therein) is wearing or deteriorating, the customer can snap or remove that brush from the line and replace it with another applicator 86 or 100 containing fresh material 122. The worn material 122 within the removed applicator 86 or 100 will then be replaced with newly cut and machined material 122. Depending upon the width of the material 12 being run by the user, perhaps the outside four or five applicators 86 or 100 will need their material 122 replaced fairly often, maybe even once a turn, depending upon how ragged the long edges of the material 12 become; however, the inside brushes may last several weeks or months in comparison. This is a great advantage over having to shut down the entire line in order to replace an oil roll which is currently used in many facilities. There is a tremendous savings in time and cost in replacing individual brushes as opposed to taking out and replacing an entire oil roll.

Furthermore, another advantage that the present device 10 has over an oil roll or an elongated pipe which drips oil onto the material 12 so that oil can be smeared and wiped by brushes or rags over the material 12 is that the density of the material 122 can be altered by the manner in which it is packed within the applicators 86 or 100, and the amount of oil that is applied to the material 12 is, thus, slightly changed by changing the density of the material 122. More oil will flow through a less dense area and less oil will flow through a higher density area, and this flow is controlled by the density of the material 122 disposed within each applicator 86 or 100, the actual compression of the wafers in pounds per square inch, and also the rotational rate of the pumps 38, i.e., the rpm at which the pumps 38 rotate. By controlling these parameters, the amount of oil being applied to the material 12 can be precisely controlled even if one or several of the brushes deteriorates so that the material 12 will still receive the proper amount of oil. This is because the rpm of the pumps 38 and the size of the tubing 46 is sized and calibrated to push a positive displaced amount of oil through each respective brush of material 122. With every rpm a fixed amount of oil in cubic inches will spread or permeate through the material 122 for application to the material 12 because once the material 122 becomes supersaturated, the oil permeating therein cannot be held or absorbed and must be forced downwardly through the material 122 for application on the material 12.

Initially, the device 10 will have to be run without the material 12 moving beneath the applicators 86 or 100 so that oil can permeate and supersaturate the material 122. If the device 10 in a particular facility has a whole new set of brushes, the customer does not want to run, and thereby lose, several hundred feet of material 12 before the brushes become supersaturated and oil starts dropping from the brushes onto the material 12. That is why the customer is advised to first run the device 10 so that the brushes can become supersaturated and to thereafter commence running the material 12. The permeation of the material 122 with oil is similar to the permeation of a sponge with water. The sponge will take in water until it becomes supersaturated; once the sponge becomes supersaturated, every ounce of water that is put into the sponge will drip out the opposite side of the sponge. The same effect is achieved by using the material 122 and the peristaltic pumps 38 of the present invention insofar as by having a positive oil feed to the brushes assures the user that he will get the exact amount of oil that he needs on the material 12 for every minute that the device 10 is in operation. This also assures that a uniform and even coating of oil will be applied to the material 12.

A critical factor in the manufacture of cans, containers, and other items for use in the food industry is the residual amount of oil allowed in the can stock. The FDA has promulgated very stringent requirements regarding the amount of residual oil in can stock, and any can stock which violates these guidelines will be rejected. Food and beverage manufacturers can only use sheet material that has an infinitesimal amount of residual oil so that their containers and other items will not be rejected by the FDA. Moreover, some food and beverage manufacturers own their own rolling mills, such as aluminum rolling mills, whereby the aluminum or other material requires a very minute amount of oil to go through the form of the die press so that it can be formed into a beverage can. While a certain amount of lubricant must be applied to the metal so that the metal will go through the form of the die press, the amount of lubricant must be just enough to permit the aluminum or other material to work in the dies so that the material can be formed; but, if the lubricant exceeds that amount, then the can stock may be rejected by the FDA. This is an example of the very fine line the manufacturers must meet and it is why critical factors such as the amount of oil applied to the material 12 per square inch or per square centimeter, the thickness or density of the oil applied thereto, the rate of wear of the material 122, and the ability of the material 122 to continue applying oil as the material 122 deteriorates are such critical factors that concern users of the device 10 and their customers.

As shown in FIG. 12, the material 122 is packed within the applicator 100 diagonal to the line of travel of the material 12. The diamond-shaped arrangement of the applicators 100 insures an overlap so that there are no bare spots without oil on the surface of the material 12. Illustrated in FIG. 13 is material 122 arranged within the applicator 86 of FIG. 8 so that the material 122 is parallel with the line of travel of the material 12. Again, the applicators 86 are arranged diamond-shaped so that they overlap one another and prevent bare spots on the material 12 having no oil applied thereto. In addition, FIG. 14 illustrates another way to cut a block of the material 122 so that it can be stacked parallel with the line of travel of the material 12. In FIG. 14, either applicator 86 or 100 is superimposed above a block of material 122, and the large block of material 122 is pre-compressed so that a smaller block can be cut out of the material 122 which conforms to the dimensions of either applicator 86 or 100. Cutting a smaller block from the pre-compressed larger block insures that the plies of material 122 are oriented in alignment parallel with the material 12. This method of cutting and stacking the material 122 within the applicator 86 or 100 eliminates the need for the end caps 88 and 90 as shown in FIG. 8.

As shown in FIGS. 1, 6, 12, and 13, the applicators 86 or 100 are arranged diagonal or diamond-shaped transverse to the path of travel of the material 12. If the applicators 86 or 100 were set square instead of diagonal to the material 12, there would be a slight space between each applicator 86 or 100 which would be parallel to the line of travel of the material 12. These spaces would create a continuous line of evenly spaced streaks on the material 12 free of oil application; aligning the applicators 86 or 100 diagonally across the width of the material 12 insures that any oil-free streaks will be wiped away and oil from an adjacent applicator 86 or 100 will be applied thereto. In addition, the diagonally-arranged applicators 86 or 100 are advantageous with regard to the physical concept of a boundary layer associated with the material 12 moving at a high speed immediately underneath the line of applicators 86 or 100.

There is a boundary layer associated with the oil that is being applied to the material 12 from the applicators 86 and 100 and there is also a boundary layer associated with the air that is trapped right up against the material 12. Because of these boundary layers, there is a tendency for the applicators 86 and 100 to ride up and skip on the material 12. In a sense, the applicators 86 and 100 hydroplane upon and above the swiftly moving material 12. The diagonal arrangement of the applicators 86 and 100 acts roughly analogous to the tire treads of a car tire in that the space between each applicator 86 and 100 creates a path for the air to move therethrough. The boundary layer of air is forced into the spaces between each applicator 86 and 100 and is permitted to escape downstream simultaneous with the movement of the material 12. Conversely, if there were no spaces between each applicator 86 and 100, the boundary layer of air would dam up behind or upstream of the applicators 86 and 100 until the boundary layer had sufficient hydrodynamic force, and then the boundary air layer would momentarily lift up a number of the applicators 86 and 100 allowing that slug of air to pass underneath and downstream of the device 10. Essentially, the boundary air layer is allowed to circulate through the gaps or spaces between the applicators 86 and 100 in the same way that water circulates outward through the channels or grooves of a tire tread. Thus, the diagonal or diamond-shaped arrangement of the applicators 86 and 100 has a two-fold purpose: (1) to provide a continuous application of the oil to the material 12 across the width of the material 12 so that streaking can be avoided by having the applicators 86 and 100 overlap one another; and (2) to provide gaps or spaces between each applicator 86 and 100 which allow the boundary layer of air to circulate or pass therethrough so that pockets of air do not accumulate between the surface of the material 12 and the bottom edge of the applicators 86 and 100, thus causing the applicators 86 and 100 to lift up off of the material 12, creating areas without oil being applied thereto.

As shown in FIGS. 1, 2, 4, 5, and 15–17, the device 10 includes a fluid control means which, in the preferred embodiment, is a plurality of cartridge valves 126 which may be electric or pneumatic solenoids. The above-cited figures show electric solenoids on either end of the device 10. The solenoids are threaded onto a nut 128 and are mounted into pre-drilled apertures extending into the rear, or downstream-facing, side 24 of the manifold 14. Contained within each solenoid is a selectively-actuated poppet (not shown) which moves linearly within the solenoid for blocking or unblocking ports on the solenoid that prevent or permit oil to flow therethrough and which communicate with channels 130 in the manifold 14. The selective lateral movement of the poppets within the solenoids directs fluid flow through the ports that communicate with channels 130 that carry fluid to the hoses 74 or, conversely, directs fluid flow through the ports which communicate with the channels 130 for recirculating fluid to the main passageway 16.

However, the use by a particular customer of a fluid control means is not a mandatory requirement for the device 10. If a customer knows he will never run any material 12 narrower than a given width, he will purchase the device 10 with only enough solenoids on either end of the manifold 14 to give him edge control of fluid application down to the minimum width of material 12 he will run. Because of the expense of the solenoids themselves and also the expense and time in cross-drilling the various channels 26 and 130 into the manifold 14 for each solenoid, the use of solenoids is optional for edge control of fluid application down to the narrowest width of material 12 that the customer will run. If the customer purchased the device 10 shown in FIGS. 1 and 2, and only ran material 12 having a width as shown in FIG. 2, the solenoids would be selected to block the channels 26 and 130 that allow fluid to flow to the hoses 74 and, instead, the fluid would be directed to recirculate through the manifold 14 and the pumps 38 associated with those respective solenoids. For example, if a customer runs only sheet material having a width of fifty-six inches and never handles anything narrower or anything wider, that customer will not order any solenoids as they would be unnecessary since the motor-driven shaft 56 will circulate fluid through the manifold 14 and pumps 38 and then down to the applicators 86 and 100 for distribution onto the material 12. However, if a customer runs not only fifty-six-inch-wide sheet material but also runs sheet material down to, for example, twenty-eight inches wide, then he may order the device 10 with the appropriate number of solenoids to go down to the twenty-eight-inch width so that when running twenty-eight-inch coils, the solenoids at either end of the manifold 14 can be actuated to shut off fluid flow to the channels 26 and 130 leading to the hoses 74 for recirculating the fluid through the manifold 14 and pumps 38 associated with those solenoids.

Illustrated in FIG. 5 is a pump 38 with an associated solenoid mounted into the side 24 of the manifold 14; illustrated in FIG. 3 is a view showing the pump 38 without the solenoid mounted thereto. In FIG. 3 the egress end 50 of the tubing 46 is in flow communication with the channel 26 drilled within the manifold 14 which connects at a T with a horizontal channel 130 which is in flow communication with hose end 76 fitted to the upper housing 78.

Illustrated in FIG. 2 is the device 10 with the motor 62 which varies up to 7.5 hp, the motor 36 which varies up to approximately 10 hp, the container 30, an oil line 28 going from the container 30 and into the manifold 14, and a manual shut-off valve 132. The general operation of the device 10 shown in FIG. 2 would include feeding a tachometer signal to the motor 62; and as the tachometer signal decreased, the motor 36 would decrease in rpm; as the tachometer signal increased, the motor 36 would increase in rpm. Also, a variable-speed PC control unit (not shown) would be used with the embodiment shown in FIG. 2. The control unit is wired from the motor 62 and a tachometer signal from any roll (not shown) supporting the material 12 and in contact with the material 12 is brought to the control unit so that electronic ratios can be set up based upon the rotation of the rolls which, in turn, permits a determination of the speed of the moving material 12. These electronic ratios are converted to the appropriate rpm to run the motor 62 which, in turn, rotates the main drive shaft 56. However, if the customer wishes to avoid hiring an electrical contractor to set up the electronics of the device 10 shown in FIG. 2, an alternative embodiment of the device 10 is available.

Figure 17:
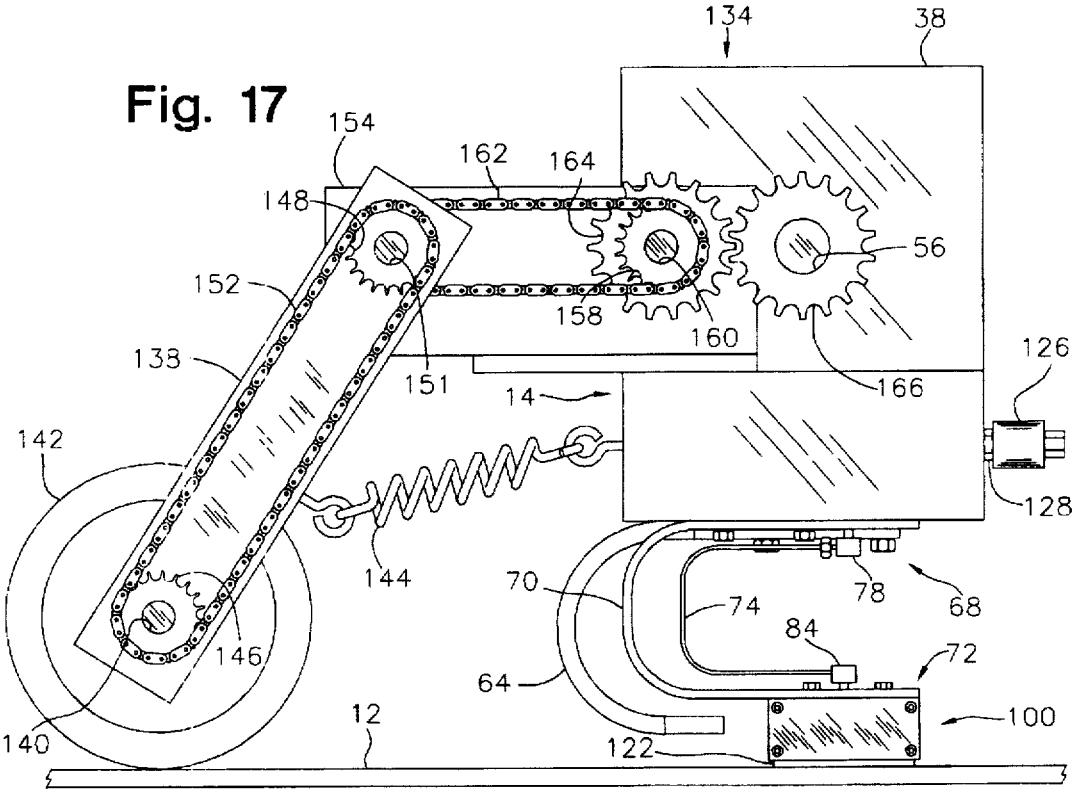
FIG. 17 is a side elevational view of an alternate embodiment for the apparatus first shown in FIG. 1.
Figure 18:
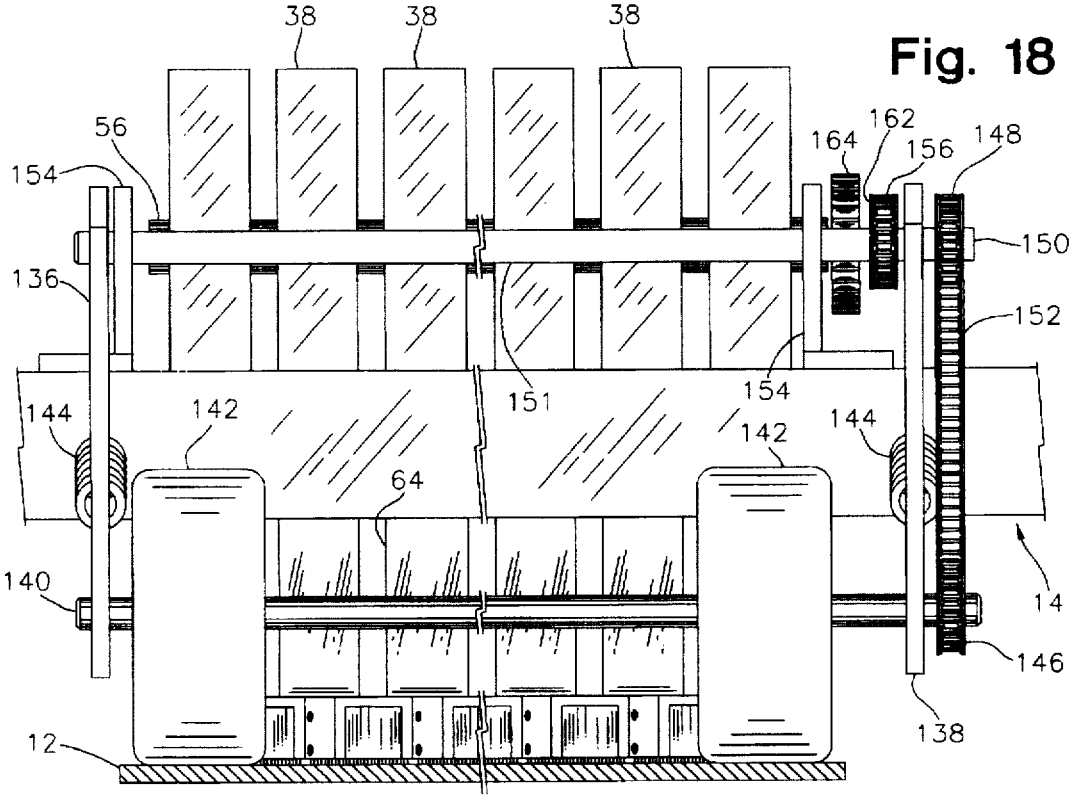
FIG. 18 is a front elevational view of the alternate embodiment of the apparatus first shown in FIG. 17.

Illustrated in FIGS. 17 and 18 is an alternative embodiment for an oiling device 134 which does not require electronics and is relatively easy to set up in any mill environment. By using a gearing and linkage system, the speed at which the material 12 moves would actually control the rotational rate of the shaft 56 and the rate and amount of oil flowing through the manifold 14 and pumps 38 to the applicators 86 and 100. Thus, when the shaft 56 stops rotating, there would be zero output from the pumps 38 because the rollers 60 would not be compressing the tubing 46 within the pumps 38. As the rotational rate of the shaft 56 increased, the volume and rate of fluid flow through the tubing 46 and to the applicators 86 and 100 would thereby increase. The advantage of the embodiment of the device 134 shown in FIGS. 17 and 18 is that the customer does not need any electrical connections for the PL control unit, and, thus, any potential problems with the electronics are avoided.

Shown in FIG. 18, which is a view looking downstream to the device 134, is the elongated shaft 56 which extends past the left-most and right-most pumps 38. Pivotally mounted at either end of the shaft 56 are, respectively, angled and elongated left-side support members 136 and right-side support members 138. The support members 136 and 138 extend at an angle toward the material 12 and each member 136 and 138 terminates at a lower end. Extending between and rotatably mounted to the lower ends of the support members 136 and 138 is a wheel or roll shaft 140. Rotatably mounted at either end of the roll shaft 140, and inside the lower ends of the support members 136 and 138, are a pair of traction wheels 142. The purpose of the wheels 142 is to get tractability from the moving material 12 so that the wheels 142 can rotate. It is possible that a wheel in the form of an elongated roll could be used in place of the two wheels 142 of FIG. 18; a single traction wheel at either end of the roll shaft 140 could also be used. Extending between and secured to the upstream-facing surface 22 of the manifold 14 and the middle portion of each support member 136 and 138 is a tension spring 144. The springs 144 help the wheels 142 to gain tractability against the material 12 and also allow the wheels 142 to ride up or down on the material 12 while still maintaining contact therewith. Moreover, the springs 144 allow the wheels 142 to move upstream or downstream (to the left or right as shown in FIG. 17), while maintaining a downward thrust or load against the material 12. Adjusting the tension of the springs 144 allows the customer to vary the degree or range of forward or backward movement of the wheels 142 upon the material 12 and also the amount of downward load or thrust of the wheels 142 against the material 12. Furthermore, the device 134 itself will create a load that will result in putting a downward vertical pressure against the material 122 so that the disposition of the springs 144 as shown in FIGS. 17 and 18, results in the wheels 142 having a tendency to load the springs 144 which assists in providing traction of the wheels 142 against the material 12.

In order to transmit the rotation of the roll shaft 140 to the main drive shaft 56 to force fluid through the pumps 38 and to the applicators 86 and 100, a chain and linkage system is used. Although the chain and linkage system could be mounted to both ends of the shafts 56 and 140, as shown in FIG. 18, the chain and linkage system is mounted to the right side (looking downstream) of the device 134. The chain and linkage system includes a sprocket 146 mounted to the end of the shaft 140 and a sprocket 148 rotatably mounted on a bushing 150 projecting from the upper end of the support member 138. Extending between both members 136 and 138, and rotatably mounted thereto, is a second spindle or shaft 151. A chain 152 that is rotatably mounted to these two sprockets 146 and 148 transmits the rotation of the shaft 140 to the sprocket 148. Mounted to the surface 18 of the manifold 14 and vertically extending upstream are a pair of opposed support members 154 which are positioned between angled support members 136 and 138 and the outermost pumps 38 on either end of the line. The ends of shaft 151 are received by and slightly extend past members 136 and 138 so that the sprocket 148 and bushing 150 can be mounted to either end of shaft 151. In FIG. 18, the sprocket 148 and bushing 150 are mounted to that portion of the shaft 151 which projects past the member 138. Positioned between the upper end of member 138 and the distal end of a right-side support member 154 is a sprocket 156. This sprocket 156 is mounted directly opposite sprocket 148 and is rotatably mounted to shaft 151. Directly in line with this sprocket 156 is another sprocket 158 which is mounted to a small shaft 160 which projects outwardly from the support member 154 and is parallel with shafts 56 and 151. A second chain 162 is trained around sprockets 156 and 158. A driving gear 164 is mounted to the same shaft 160 as sprocket 158, but is positioned inside the sprocket 158 adjacent to the support member 154. The driving gear 164 meshes with a driven gear 166 which is rotatably mounted to the end of the shaft 56 which projects slightly past the rightmost pump 38. Thus, once the material 12 starts moving beneath the device 134, the traction of the wheels 142 against the material 12 causes the chain and linkage system to transmit driving motion to the gear 164 which, in turn, causes the gear 166 to rotate, and thereby causes the shaft 56 to rotate, forcing fluid through the pumps 38 and to the brushes.

Figure 20:
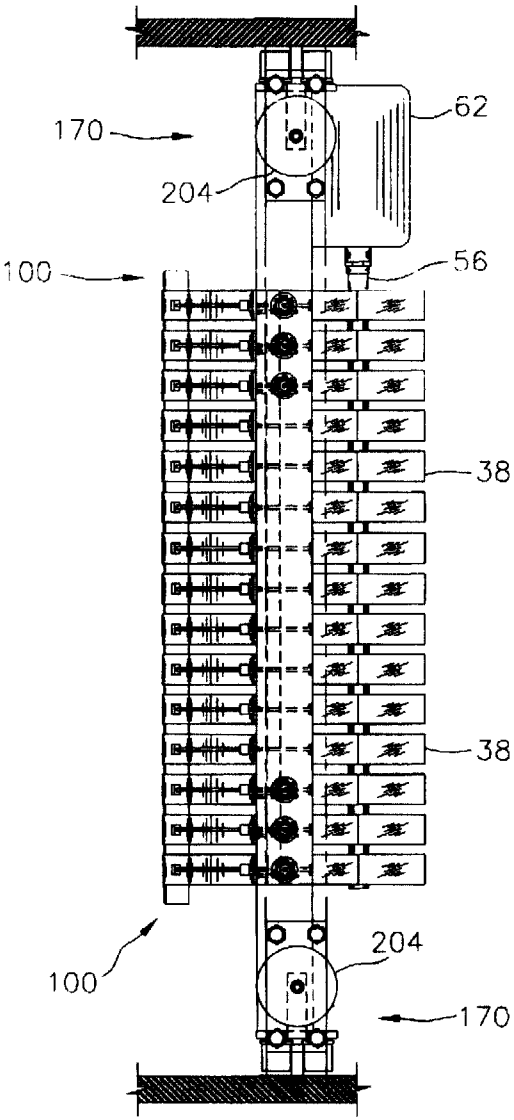
FIG. 20 is a top plan view of the apparatus first shown in FIG. 19.
Figure 19:
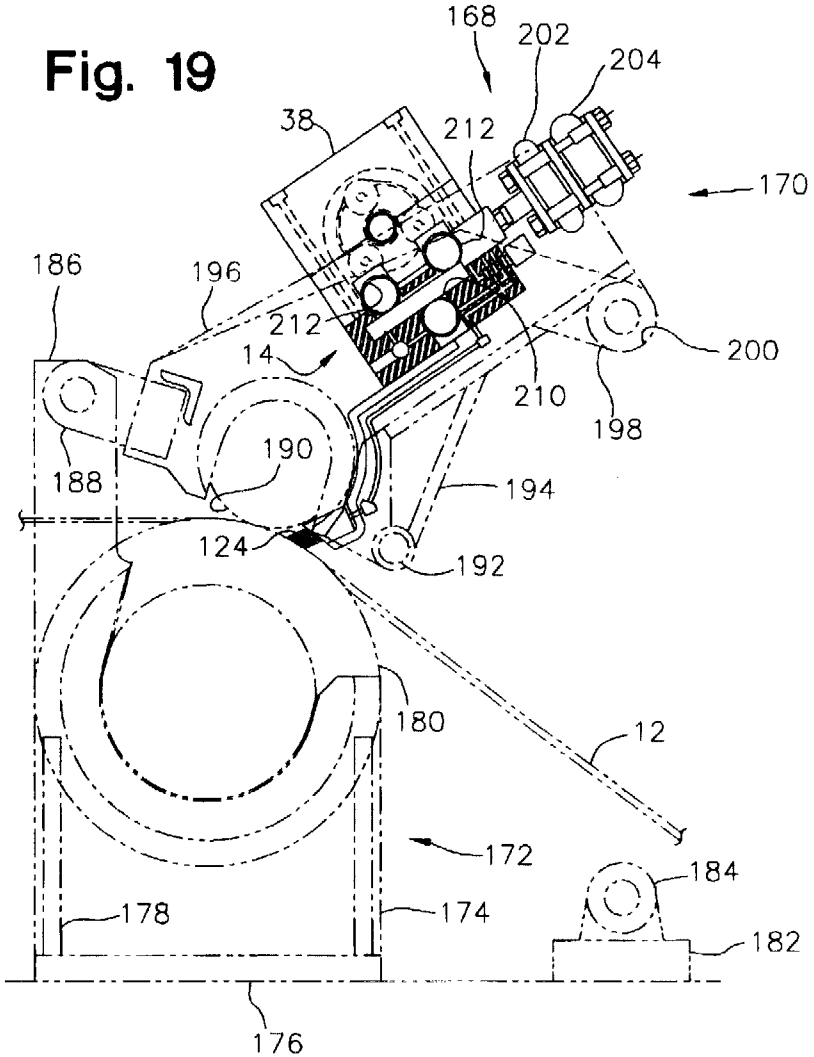
FIG. 19 is a second alternate embodiment of the apparatus first shown in FIG. 1 illustrating the use of roll loaders with the apparatus.

Illustrated in FIGS. 19 and 20 is an alternate embodiment for an oiling device 168 which is used in combination with roll force assemblies found in certain special process lines. It has long been known that in order to improve roll and brush life on process lines a critical factor is the ability to accurately load the contact surface of the roll or brush (also known as the "nip") in order to extend the service life or working life of the bonded surfaces, such as rubber or other synthetic covers. This is also true of brush rolls and other synthetic pad material. In the past, the choices for adjusting rolls or brushes were of two types: (1) manually adjustable springs; and (2) pneumatic and hydraulic cylinders. For example, in some processing lines containing ringer rolls, manually adjustable springs were used to adjust the load of the rolls against the strip of material. However, this presented the problem of varying the roll load (or nip pressure) as the rolls wore and deteriorated. The springs required constant adjustment and because no simple, accurate means was available to indicate the true force being applied to the roll, the optimum force for obtaining maximum roll life was rarely obtained. Therefore, a second means to adjust nip pressure or nip roll force was conceived which utilized the use of pneumatic or hydraulic cylinders. The principle was that by applying pressure to the cylinder, a known force was believed to be applied to the roll. Nonetheless, this technique did not account for the weight of the roll; therefore, the downward-directed roll weight against the strip of material was added to the cylinder force, thereby creating excess nip pressure and premature roll pressure resulting in excessive brush wear and deterioration.

Moreover, changes in the thickness of the strip being run, bends in the product from traversing in and out of looping pits, and the presence of welded seams throughout the transverse width of the material and along the length of the material added additional problems for the cylinders and springs. For example, the downwardly-directed spring force increases as the strip of material attempts to force the roll upward against the spring, thus creating higher nip pressure and the opportunity for roll failure. On the other hand, pneumatic or hydraulic cylinders can be regulated, but excess pressure must first be created to overcome the spring setting of the regulator. Moreover, the friction of the seals on the piston and rod and the additional drag force on the cylinder assure that the cylinders would not respond quickly to changing conditions of the strip being processed. Finally, the harsh environment of the milling operations in the processing mills caused corrosion on the cylinder bores and rods, further decreasing reaction time and adding detrimental effects to the particular rolls or brushes being used.

The roll force assembly used in conjunction with the device illustrated in FIGS. 19 and 20 is the squeeze roll and actuator assembly utilizing inflatable bags which is covered in U.S. Pat. No. 4,928,589, and is more commonly known as the Schofield roll loader 170. The Schofield roll loader 170 is ideal for this application of the device 168 in that it provides an accurate and easily adjustable or variable way to load the brushes of the device 168 against the material 12 traveling therebeneath and to which oil is applied. For this application the customer must be careful to avoid mashing the material 122 against the material 12 in order to avoid having the applicators 86 or 100 lift or bounce upward away from the material 12 as it travels beneath the applicators 86 or 100. The Schofield roll loader 170 permits the segmented applicators 86 or 100 to be kept in good position relative to the moving material 12.

A structure 172 supporting the material 12, the device 168, and the roll loader 170 may vary depending on the requirements of the processing line and the mill operation. The embodiment shown in FIGS. 19 and 20 includes a bottom deflector roll support structural gusset 174 extending upwardly from a bottom deflector roll support base plate 176. A second bottom deflector roll support structural gusset 178 is spaced from the first gusset 174 and also projects upwardly from the plate 176. Mounted on the gussets 174 and 178 is a bottom deflector roll 180 upon which the undersurface of the material 12 travels. Spaced from the roll 180 and gussets 174 and 178 is a cross-over support plate 182 upon which is mounted a cross-over support tubing 184. The tubing 184 is used to pick up and support the material 12 which may droop or start to loop downward as it travels over the roll 180. A top hold-down roll pivot support 186 projects upwardly past the path of travel of the material 12, and mounted to the pivot support 186 is a top hold-down pivot bracket 188. A top hold-down roll 190 is positioned above the roll 180 and is supported in its transverse extension across the line by an elongated cross-tie deflector support tube 192 and a vertically-projecting top hold-down roll deflector plate 194 which projects upwardly from the tube 192. An end plate 196 extends above the roll 190 while a cross-tie bracket 198 and an elongated cross-tie tubing 200 are located downstream of and help to support the device 168. The plate 194 extends upwardly from the tube 192 and helps to support the bracket 198 and tubing 200 in their transverse disposition across the line.

The guard 64 which is shown in FIGS. 2–5 and 15–18 is not necessary in this application due to the rolls 180 and 190 while the springs 66 and tubing 46 shown in FIGS. 2–5 have been altered to conform to this application of the device 168. However, the segmented arrangement of the applicators 86 or the line and the use of the line and the use of multiple peristaltic pumps 38 ganged together on a single shaft 56 has not been changed from FIGS. 1–5 and 15–18. Two sets of bellows are used in this application. FIG. 19 shows bottom bellows 202 and top bellows 204, forming a pair working in combination, while the top plan view of FIG. 20 shows the top bellows 204 of each pair.

During pressurization or depressurization of the bellows 202 and 204, the entire line of the device 168, including the pumps 38, the manifold 14, and segmented springs 206, applicators 86 or 100, and tubing 208, must be free to float slightly upward or downward relative to the material 12. A bar 210 is mounted at each end of the line to mounting structure and three rollers 212 are disposed in contact with each bar 210 so that the rollers 212 will roll or slide up and down on each bar 210 so that the entire line of pumps 38, manifold 14, springs 206, applicators 86 or 100, and tubing 208 can float upward or downward relative to the material 12. The bars 210 provide a surface for the rollers 212 to roll on.

In order to achieve the appropriate and accurate nip pressure, the bellows 202 and 204 would be pressurized or depressurized from a control panel unit (not shown). From the control unit, air pressure to the bellows 204 would be regulated in order to create an upward force which just balances the downward weight of the device 168 against the material 12. Then, by using an adjustable pressure regulator, the air pressure to the bellows 202 is adjusted to give an accurate nip force or pressure (pound force per lineal inch of roll) across the brushes to balance the dead weight of the device 168. The air pressure of the bellows 202 and 204 could then be increased or decreased, as necessary, so that a true nip force or pressure of the brushes against the material 12 is obtained. For example, if a customer wants to put twenty-five pounds of force per lineal inch on the device 168 across the transverse width of the material 12, by using the control panel to regulate the bellows 202 and 204, the operator can null out the weight of the device 168 to achieve that force of the device 168 against the material 12. The appropriate amount of force can be dialed in from the control panel, and the operator can regulate the air pressure going to the bellows 202 and 204 by dialing the pressure in from the control panel. The load can be set from the control panel and air pressure in any of the bellows 202 and 204 can be dumped from the control panel. Thus, roll force assemblies, such as the Schofield roll loader 170, allow the customer to increase his roll or brush life, obtain an exact nip pressure on the rolls or brushes he is using in his line, and the Schofield roll loader 170 also allows the customer to achieve quick and easy adjustment in nip pressure depending upon the density and type of material 12 being run.

Although several embodiments of the present invention have been illustrated and described, it will be apparent to those skilled in the art that various changes and modifications may be made therein without departing from the spirit of the invention or the scope of the appended claims.

I claim:

1. Apparatus for distributing fluid onto a moving workpiece, comprising:

a manifold positioned above and extending transverse to the moving workpiece;

a fluid container which is in flow communication with the manifold so that fluid can flow from the container and into the manifold;

a plurality of pumps serially mounted on the manifold for receiving fluid from the manifold and then forcing fluid through the manifold and onto the workpiece;

a plurality of U-shaped springs serially mounted to the bottom of the manifold so that each respective spring is paired with each respective pump, and the springs are capable of deflection to or away from the moving workpiece;

a plurality of hoses serially arranged so that each respective hose is contained within the bight portion of each respective spring and each hose has a first end in flow communication with the manifold and an opposite second end; and means for distributing the fluid onto the workpiece so that the entire width of the workpiece receives a uniform coating of fluid as the workpiece moves therebelow, the means for distributing the fluid onto the workpiece mounted to each respective spring superjacent the workpiece and in flow communication with each respective hose.

2. Apparatus for dispensing oil onto moving sheet material, comprising:

an elongated manifold positioned above and transverse to the moving sheet material;

an oil container which is in flow communication with the manifold so that the oil can flow from the container and into the manifold;

a plurality of pumps serially mounted superjacent to the manifold for receiving oil from the manifold and then forcing oil through the manifold and onto the moving sheet material;

a plurality of springs serially mounted to the bottom of the manifold so that each respective spring is paired with each respective pump and all the springs are capable of deflection to or away from the sheet material;

a plurality of hoses with each hose having a first hose end in flow communication with the manifold and an opposite second hose end, and each respective hose is contained within each respective spring; and means for distributing the oil onto the moving sheet material so that the entire width of the sheet material receives a uniform coating of oil, the means for distributing the oil onto the sheet material mounted to each respective spring and in flow communication with each respective hose.

3. The apparatus of claim 2 wherein the means for distributing the oil onto the workpiece includes a plurality of applicators with each applicator removably attachable to each respective spring and deflectable to or away from the sheet material concomitant with the deflection of that respective spring.

4. The apparatus of claim 3 wherein the means for distributing the oil onto the sheet material includes a plurality of non-woven spun-bonded nylon brushes packed inside each applicator for absorbing oil from the hoses and then dispersing the oil onto the moving sheet material.

5. The apparatus of claim 4 wherein the nylon brushes are packed within the applicators perpendicular to the sheet material and parallel to the path of travel of the moving sheet material.

6. The apparatus of claim 5 wherein the nylon brushes are packed within the applicators perpendicular to the sheet material and diagonal to the path of travel of the moving sheet material.

7. The apparatus of claim 3, wherein the applicators are spaced above the moving sheet material and are arranged diagonal thereto so that the applicators overlap one another to facilitate a uniform distribution of oil across the width of the moving sheet material.

8. Apparatus for applying fluid to a moving strip of sheet material, comprising:

a manifold positioned above and extending transverse to the sheet material;

means for supplying fluid to the manifold;

a plurality of serially aligned pumps mounted upon the manifold for receiving fluid from the manifold and then forcing fluid through the manifold and onto the moving strip of sheet material;

a plurality of serially aligned springs secured to the bottom surface of the manifold which are capable of deflection to or away from the sheet material;

a plurality of hoses contained within the springs with each hose having a first end secured to the bottom surface of the manifold and in flow communication therewith and an opposite second end; and application means for applying fluid to the sheet material, the application means secured to the springs and in flow communication with each respective hose so that fluid enters the application means from each respective hose and is then applied in a uniform coating to the moving sheet material.

9. The apparatus of claim 8 further comprising a means to regulate fluid flow through the pumps so that fluid flow through the pumps can be selectively halted or permitted.

10. The apparatus of claim 8 further comprising an elongated guard mounted to the bottom surface of the manifold adjacent the springs for protecting the springs and the application means from being struck by the moving sheet material.

11. Apparatus for dispersing fluid onto a moving strip of sheet material, comprising:

an elongated manifold positioned above and transverse to the sheet material;

a plurality of pumps serially mounted on the manifold for receiving fluid from the manifold and then forcing fluid through the manifold and onto the moving strip of sheet material;

means for dispersing the fluid onto the sheet material so that the entire width of the sheet material receives fluid as the sheet material moves therebelow, the means for dispersing fluid onto the sheet material being in flow communication with the manifold so that fluid can be received therefrom; and deflection means for allowing the means for dispersing the fluid onto the sheet material to deflect to or away from the sheet material as a result of variations in the physical characteristics of the sheet material so that dispersal of fluid onto the moving sheet material can occur simultaneous with the deflection.

12. Apparatus for dispersing fluid onto a moving strip of sheet material, comprising:

a manifold positioned above and transverse to the sheet material;

a plurality of pumps serially mounted on the manifold for receiving fluid from the manifold and then forcing fluid through the manifold and onto the moving strip of sheet material;

means for dispersing the fluid onto the sheet material so that the entire width of the sheet material receives a uniform coating of fluid as the sheet material moves therebelow, the means for dispersing the fluid onto the sheet material being in flow communication with the manifold for receiving fluid therefrom;

deflection means for allowing the means for dispersing the fluid onto the sheet material to deflect to or away from the sheet material as a result of variations in the physical characteristics of the sheet material so that dispersal of fluid onto the moving sheet material can occur simultaneous with the deflection; and traction means for continuously contacting the sheet material and which is drivingly connected to the pumps so that the velocity of the moving sheet material as it contacts the traction means regulates fluid flow through the pumps to the means for dispersing the fluid.

13. The apparatus of claim 12 wherein the deflection means includes a plurality of springs serially mounted to the bottom surface of the manifold so that each respective spring is paired with each respective pump, and the springs are capable of deflection to or away from the sheet material.

14. The apparatus of claim 12 wherein the means for dispersing the fluid onto the moving sheet material includes a plurality of applicators with each applicator removably attachable to each respective spring and deflectable to or away from the moving sheet material concomitant with the deflection of that respective spring.

15. Apparatus for distributing fluid onto a moving workpiece, comprising:

a manifold positioned above and extending transverse to the moving workpiece;

means for supplying fluid to the manifold;

means for forcing fluid through the manifold and onto the moving workpiece;

a plurality of springs serially mounted to the bottom of the manifold which are capable of deflection to or away from the moving workpiece;

a plurality of hoses serially arranged so that each respective hose is contained within each respective spring and each hose has a first end in flow communication with the manifold for receiving fluid and an opposite second end for discharging fluid; and means for distributing fluid onto the workpiece so that the entire width of the workpiece receives a uniform coating of fluid as the workpiece moves therebelow, the means for distributing the fluid onto the workpiece mounted to each respective spring superjacent the workpiece and in flow communication with each respective hose.

* * * * *